US006142436A

United States Patent [19]

Thurston et al.

[11] Patent Number: 6,142,436

[45] Date of Patent: Nov. 7, 2000

[54] FRONT-MOUNTING ADJUSTABLE HANGER SYSTEM

[76] Inventors: David Paul Thurston, 129 Paradise Hill Rd.; Eric Thurston Wight, E. Bethel Rd., both of Bethel, Me. 04217

[21] Appl. No.: 08/990,355

[22] Filed: Dec. 15, 1997

Related U.S. Application Data

[63] Continuation-in-part of application No. 08/661,987, Jun. 12, 1996, abandoned.

[51] Int. Cl.[7] ..... A47B 96/00; A47K 1/00; A47K 5/00; E04G 5/06

[52] U.S. Cl. ..... 248/222.51; 211/100

[58] Field of Search ..... 211/100, 99, 171; 248/222.51, 225.11, 220.22, 308, 294.1, 291.1

[56] References Cited

U.S. PATENT DOCUMENTS

| | | | |
|---|---|---|---|
| 287,655 | 10/1883 | French | 211/100 |
| 306,319 | 10/1884 | Carpenter | 211/171 X |
| 337,604 | 3/1886 | McKelvey | 211/100 |
| 372,217 | 10/1887 | Goss | 211/100 |
| 461,964 | 10/1891 | Sobolewski | 211/171 X |
| 909,679 | 1/1909 | Rose | 211/100 |
| 1,496,739 | 6/1924 | Ranson | 211/100 |
| 1,642,963 | 9/1927 | Lynch | 211/10 |
| 2,325,478 | 7/1943 | Collins | 211/171 X |
| 2,460,505 | 2/1949 | Jahoda | 211/100 |
| 2,715,966 | 8/1955 | Tieck | 211/94 |
| 3,313,424 | 4/1967 | Gingher | 211/113 |
| 4,085,867 | 4/1978 | Heller | 248/222.51 X |
| 4,094,415 | 6/1978 | Larson | 211/57.1 |
| 4,211,379 | 7/1980 | Morgan et al. | 248/222.51 |
| 4,527,694 | 7/1985 | Bolt | 211/46 |
| 4,694,965 | 9/1987 | Parnell | 248/222.51 X |
| 4,805,784 | 2/1989 | Sholheim et al. | 211/94 |
| 4,826,021 | 5/1989 | Burrell | 211/70.6 |
| 5,078,270 | 1/1992 | Campbell | 206/444 |
| 5,097,966 | 3/1992 | Miller | 211/87 |
| 5,138,803 | 8/1992 | Grossen | 248/222.51 X |
| 5,259,519 | 11/1993 | Lieberman | 211/66 |
| 5,429,252 | 7/1995 | Liu | 211/94 |
| 5,472,167 | 12/1995 | Shillington et al. | 248/552 |
| 5,495,953 | 3/1996 | Bearth | 211/40 |
| 5,547,156 | 8/1996 | Djuric | 248/307 |
| 5,582,376 | 12/1996 | Thomson | 248/214 |

OTHER PUBLICATIONS

Snow River Wood Products Catalog p; 1/96; Item No. 03362.

*Primary Examiner*—Ramon O. Ramirez
*Assistant Examiner*—Jerome DeLuca
*Attorney, Agent, or Firm*—Mark D. Lorusso

[57] ABSTRACT

An adjustable hanger system is disclosed comprising a base member with at least one channel and a plurality of hanging elements. The base member has bore holes and counterbores concentric with the bore holes, adapted to receive mechanical fasteners that secure the adjustable hanger system to a support surface. The base member channel is comprised of two differently sized sections within which a radiused bottom portion of the hanging elements are slidingly and matingly engageable such that the hanging elements can be inserted from a front surface of the base member. The hanging elements have top portions which are used to suspend a wide variety of articles and implements in an organized, space saving manner. Once inserted into the channel, the hanging elements can be positioned in an infinite number of positions to accommodate any particular item for which hanging and storage is desired. In some embodiments, the base member has a cove or groove to provide storage for hanging elements not in use.

18 Claims, 36 Drawing Sheets

FRONT-MOUNTING ADJUSTABLE HANGER SYSTEM

CROSS-REFERENCE TO RELATED APPLICATION

This is a continuation-in-part application of Ser. No. 08/661,987 filed Jun. 12, 1996, now abandoned, the contents of which are incorporated herein by reference.

BACKGROUND OF THE INVENTION (1) Field of the Invention

This invention relates generally to storage rack systems for various objects such as home and garden tools and equipment such as sporting equipment, e.g., tennis racquets and skis. More particularly, the present invention relates to adjustable mounting apparatus for storing various items of varying dimensions along a support surface.

(2) Description of Related Art

In an ever expanding commercialized society in which material possessions are accumulated in ever increasing numbers, there is a need for organization systems that can accommodate a wide variety of material goods that come in all shapes, and sizes. As possessions increase, the amount of available storage space decreases thereby emphasizing/increasing the need for organization or storage systems that can handle the situation.

Another important reason for storage systems is that they facilitate locating a particular object when needed. For example, it is not uncommon for an implement such as a hammer to become buried under many items tossed together on a work bench or table. A properly designed storage system can eliminate this problem.

Though there have been innumerable storage systems developed in the past, only a few have the capacity to infinitely adjust to accommodate the shape and dimensions of a particular item. One such example that utilizes adjustable pegs is sold by Snow River Wood Products located in Brattleboro, Vt. The Snow River peg rack uses a rail system to support pegs that can be positioned by sliding the pegs along the rails. The rack system consists of pairs of parallel rails secured to two base rails oriented perpendicular to the parallel rail pairs. The rail pairs are spaced to accommodate hanging pegs. The pegs used in the system have base portions within which slots are formed to matingly engage the rails.

Although this rack system features peg adjustability, the overall design is fraught with problems and deficiencies. The most significant problem is the lack of bearing surfaces adequate to accommodate the forces generated by hanging heavy objects from the pegs. Because this peg rack system uses rails, the system has no back portion to adequately absorb, counter and carry the forces generated when a heavy object is placed on a peg. The entire load generated by a hanging object is carried by relatively small portions of the peg base portion that. are in mating engagement with the rails. Because such relatively small sections of the peg are actively involved in supporting the weight of the object, hanging relatively heavy objects on this rack system will likely lead to breakage and system failure. Thus, this deficiency limits the kinds of objects that can be suspended by this hanger system based on weight.

Another limitation of this system relates to its manufacture. This peg rack system includes at least five individual parts: two base rails, two parallel rails, and at least on peg. Accordingly, numerous steps must be taken to make the individual parts and assemble the parts. Inevitably, manufacturing costs are high relative to systems such as the present invention that have fewer parts.

Additionally, because of the particular design of the Snow River peg rack system, the pegs must be subjected to more machining steps than conventional pegs used in peg boards. As a result, the expenses of manufacture are further increased.

A further limitation of the Snow River peg rack design relates to the number of pegs that can be used in the system. The number of pegs that can be used is static due to the design. Pegs cannot be added or removed from the rack system but are permanently locked into the rack during manufacture. The pegs are restricted by base rails which act as terminal blocks. Therefore, a need for more pegs cannot be satisfied without purchasing additional peg rack systems. Likewise, pegs that are not in use cannot be removed to allow for greater flexibility in the placement of pegs that are in use.

Another hanger system that has some degree of adjustability is the hanger system disclosed in U.S. Pat. No. 5,097,966 to Miller. In the Miller patent, a hanger system is disclosed in which a series of pegs project from a base member that can be secured to a support surface such as a wall. The pegs are inserted into bore holes located along the length of the base member. The user can adjust the distance between adjacent pegs by placing the pegs in different bore holes. Although this allows for some flexibility in the adjustments that can be made, the amount of adjustment that can be made is limited to the number and spacing of the bore holes which, of course, are finite in number. Objects that one desires to store on the hanger system that do not fit within any combination of pegs will not be stored on the peg board hanger system.

A yet further hanger system that also exhibits some flexibility is the hanger disclosed in U.S. Patent No. 4,094,415 to Larson. The Larson hanger is comprised of an elongate channel member with grooves or recesses established in a lower flange of the channel. The hanging members have bases that are triangular in shape and configured to allow insertion of the bases from the front of the channel through the grooves or recesses. Once inside the channel, the hanging members can slide along the channel to accommodate a variety of hanging positions.

The use of recesses to allow for front insertion of the hanging elements limits the size of the hanging member base that can be used. With the Larson design, the base has to be triangular in shape and must have side lengths that are slightly less than the distance between the upper edge of the channel at a point behind an upper flange and the lowest point of the recess. Any hanging member that requires a base that is larger than the aforementioned dimensions cannot be used with the front-mounting embodiment of the Larson hanger. Thus, for example, a hanging element with an elongated base is not capable of front insertion in the Larson hanger system. This limitation is readily apparent when the hanger system is mounted in the corner of two adjoining walls.

The inability to accommodate all items and all hanging elements adapted to accommodate a wide variety of items has continued, and will continue, to increase with the advent of more and more products of varying sizes and shapes. To address the situation, one has to obtain different hanger systems to adequately accommodate a vast array of products. Accordingly, there is a long felt need for a hanger system that is infinitely adjustable to handle a wide variety of objects that one desires to store in an organized and space saving fashion.

SUMMARY OF THE INVENTION

It is, therefore, an object of the present invention to provide a hanger system that has the capability to infinitely adjust to a wide variety of objects that one desires to store thereby eliminating the need to purchase different hanger systems to store different sized products or possessions.

Another object of the present invention is to provide an adjustable hanger system that is easy to assemble and simple to use.

An additional object of the present invention is to provide an adjustable hanger system that allows for the addition and removal of pegs.

Another additional object of the present invention is to provide an adjustable hanger system that allows for the front insertion of hanging elements that have a variety of hanging element base sizes.

A further object of the present invention is to provide an adjustable hanger system that is inexpensive and thus a cost effective way to store a variety of objects or possessions.

A still further object of the present invention is to provide a hanger system that maximizes one's ability to store possessions to save valuable storage space.

The hanger system described herein includes a base member that can be secured to a support surface. The base member has at least one channel, a means to secure the base member to the support surface and at least one peg, hook, or hanging element projecting from a front surface of the base member. The base member can also have a rectangular groove, dove-tail-like groove, cove, or concave shelf on the base member top surface, and/or a dove-tail-like groove on a bottom surface of the base member that can be used to store pegs or hooks that are not presently in need of use.

More specifically, an adjustable hanger system is claimed which is comprised of a base member having a front surface, back surface, top surface, bottom surface, two sides and at least one channel opening to said front surface. The adjustable hanger system is also comprised of hanging elements sized and shaped to slideably and matingly engage the base member channel and to project from the front surface of the base member. The hanging elements can have a base portion designed to slideably and matingly engage the base member channel and top portions designed to project from the front surface of the base member.

The base member has bore holes for mounting the base member to a support surface with mechanical fasteners which are sized to fit within the bore holes. The base member can also be mounted to a support surface with an adhesive.

The channel in the base member has a first section and a second section. The first section is designed to have a length dimension, taken along the plane between the base member top edge and the base member bottom edge, greater than the length dimension of the second section. The second section is oriented towards the front surface of the base member relative to the adjacent first section which is oriented towards a midpoint between the front surface and the back surface of the base member.

In one embodiment, the first section of the channel can have a frusto-conical, spherical, rectangular, or square cross-sectional shape. If desired, the channel first section can also be designed to have any regular or irregular geometric cross-sectional shape. The channel can be formed to run the entire length of the base member. Alternatively, the channel can be designed to run partially along the length of the base member.

In another embodiment, the channel has a bottom flange that is chamfered or radiused to allow for the front insertion of hanging elements. The chamfer or radius of the bottom flange can be continues along the entire length of the flange or only occupy a portion of the entire length of the flange.

Another feature of the adjustable hanger system is the inclusion of optional end-stops sized and shaped to releasably lock into the channel to prevent the hanging elements from falling out of the channel if the channel extends to the sides of the base member. If desired, the end-stops can be locked in the channel with an adhesive or appropriate mechanical fastener such as a screw.

The hanging elements of the claimed adjustable hanger system can be made with top portions having circular, square, or rectangular cross-sectional shapes. If a circular cross-sectional shape is used, notches can be formed on the hanging elements so that the notches are oriented toward the top surface of the base member. The top portion of the hanging elements can also be formed in the shape of a hook.

In one embodiment, the hanging elements are retractable arm hanging elements which have top portions with at least one retractable arm which is comprised of a retractable arm shaft and end balls situated on either end of the shaft. The end balls are sized to arrest sliding movement of the retractable arm through apertures situated in a hanging element body.

Bottom portions of the hanging elements can be configured to matingly engage the channel of the base member. In one embodiment, the base portions of the hanging elements can be radiused to allow for front-insertion into the channel of the base member.

The adjustable hanger system can also be made with a second channel on the top surface of the base member to receive hanging elements that are not in use or in an inactive state. This second channel can be made with a square, rectangular, spherical, frusto-conical, or cove, oval-like cross-sectional shape. Alternatively, if a frusto-conical shape is used for the second channel, the channel can be formed on the bottom surface of the base member.

If desired, the base member of the adjustable hanger system can be used as a primary support surface for a top member which is formed with a channel. In this alternative embodiment, the adjustable hanger system is comprised of a bottom having a front surface, back surface, top surface, bottom surface, and two sides; a top member having a top member front surface, a top member back surface, a top member top surface, a top member bottom surface, two top member sides, and a top member channel. The hanging elements of this alternative embodiment are sized and shaped to slideably and matingly engage the top member channel and to project from the top member front surface.

Finally, a method for hanging an object in a selected position is claimed comprising: providing a base member with a channel, providing hanging elements adapted to slideably and matingly engage the channel, having radiused bottom portions and having portions projecting from a front surface of the base member, inserting the hanging elements into the channel from either the side or front of the base member, and hanging the object on the hanging elements.

BRIEF DESCRIPTION OF THE DRAWINGS

FIG. 1 is a front perspective view of the base member of one embodiment of the invention.

DESCRIPTION OF THE PREFERRED EMBODIMENTS

Figure 1A:
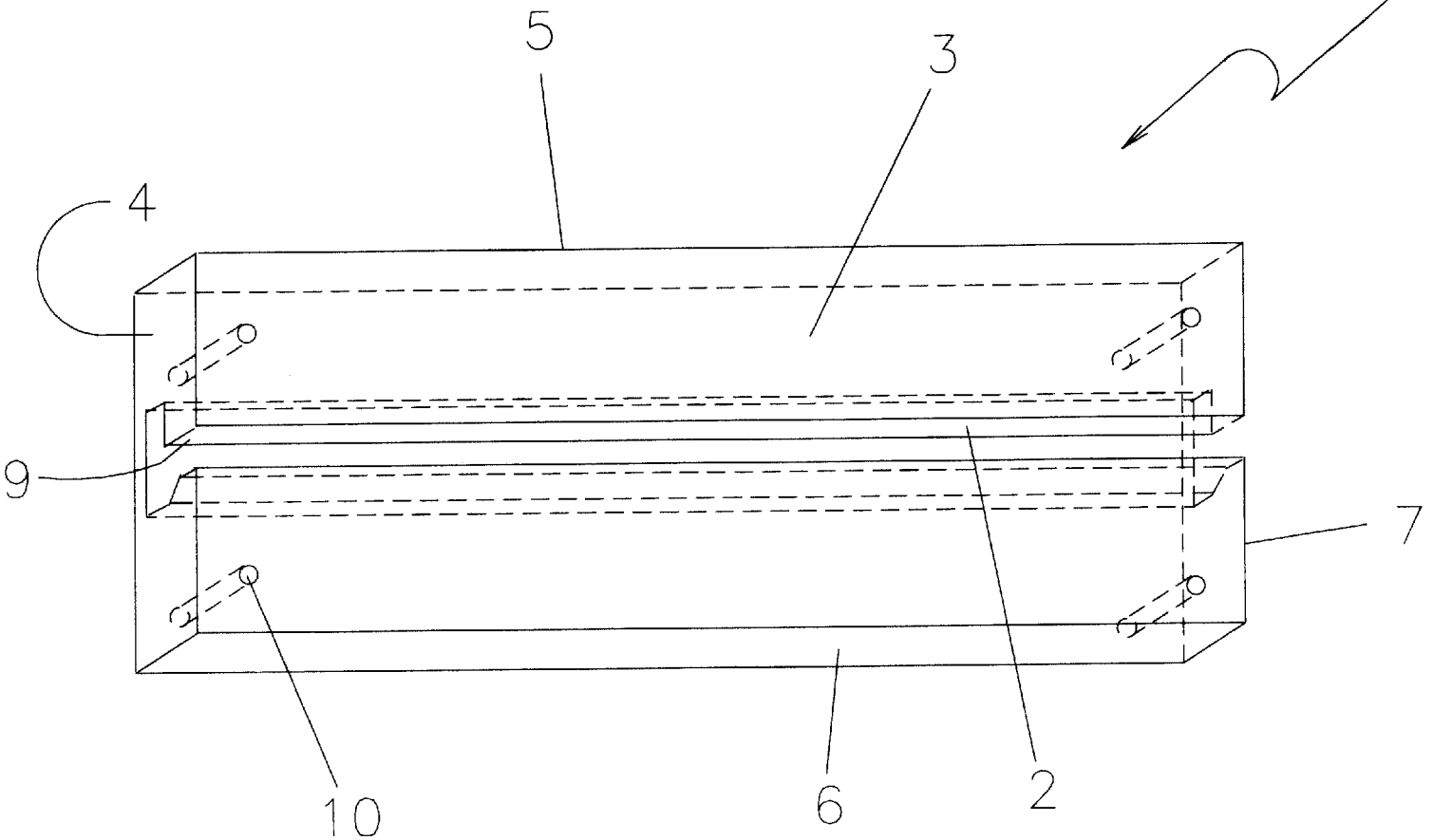
FIG. 1*a* is a front perspective view of the base member of another embodiment of the invention.

The present invention generally relates to hanger systems. The invention can be used to hang and store, a wide variety of items such as clothes, household implements, e.g., brooms and dust pans, garden and lawn tools, sporting equipment, and any other items the user desires to hang and store, in an organized and space saving fashion.

Referring to FIGS. 1, 1*a*, 1*b* and 2, it will be seen that the assembly of the present invention has a base member 1 within which a channel 2 is formed. Base member 1 is preferably rectangular in shape but may conform to any shape to suit any particular need, location, or space. Base member 1 has a front surface 3, back surface 4, top surface 5, bottom surface 6, and two sides 7.

To secure base member 1 to a support surface, bore holes 10 are included so that base member 1 can be secured to a support surface with a mechanical fastener 11. Counterbores 10*a* are included concentric with bore holes 10 to accommodate the head of mechanical fastener 11 to allow mechanical fastener 11 to be placed flush with front surface 3. Mechanical fastener 11 can be a screw, lag screw, bolt, nail, or any other suitable mechanical fastener. Base member 1 can also be secured to a support surface with an appropriate adhesive 11*a* as shown in FIG. 3*b* thereby eliminating the need for bore holes 10.

Figure 2:
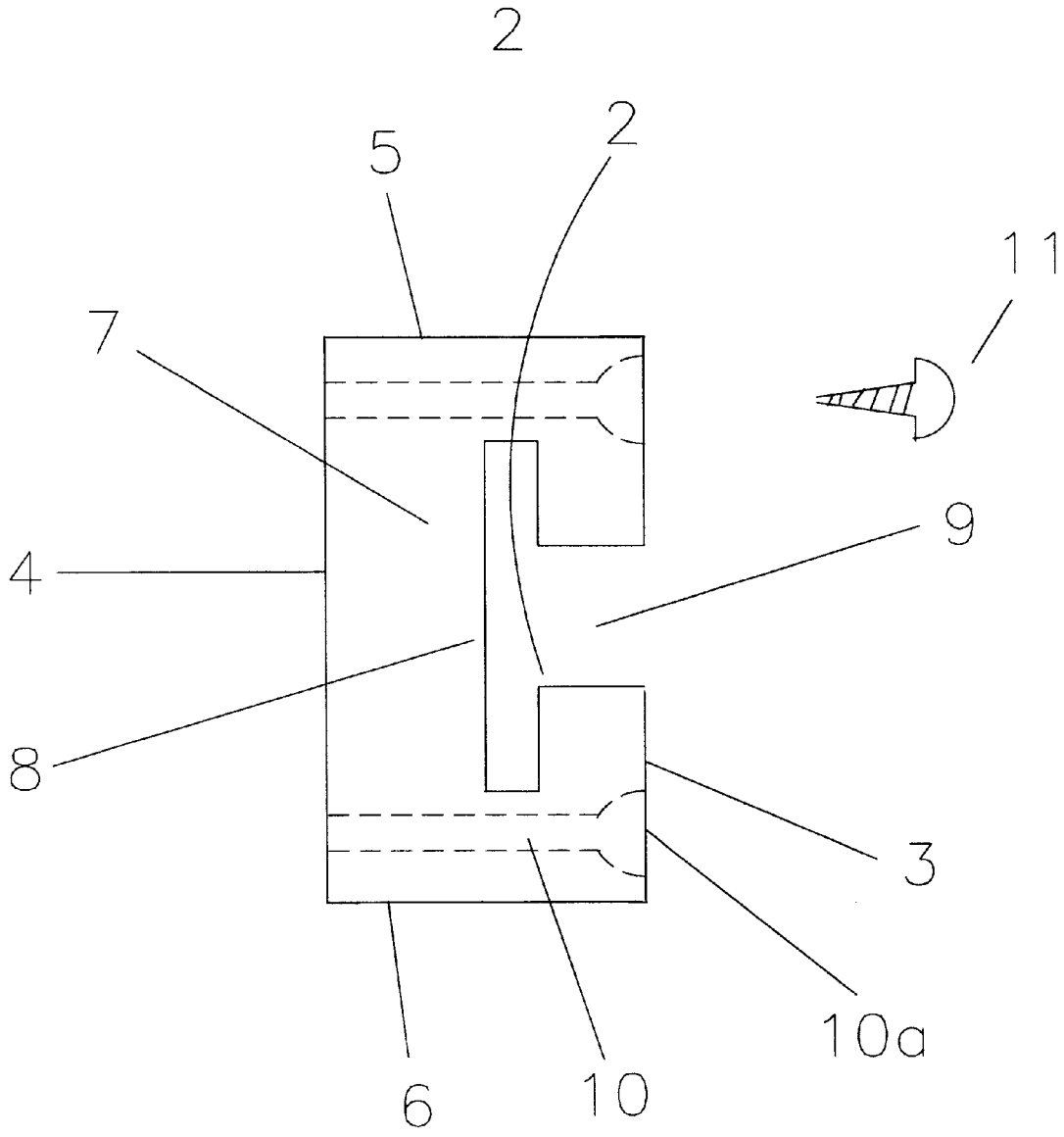
FIG. 2 is a side elevational view of the base member of one embodiment of the invention.
Figure 2A:
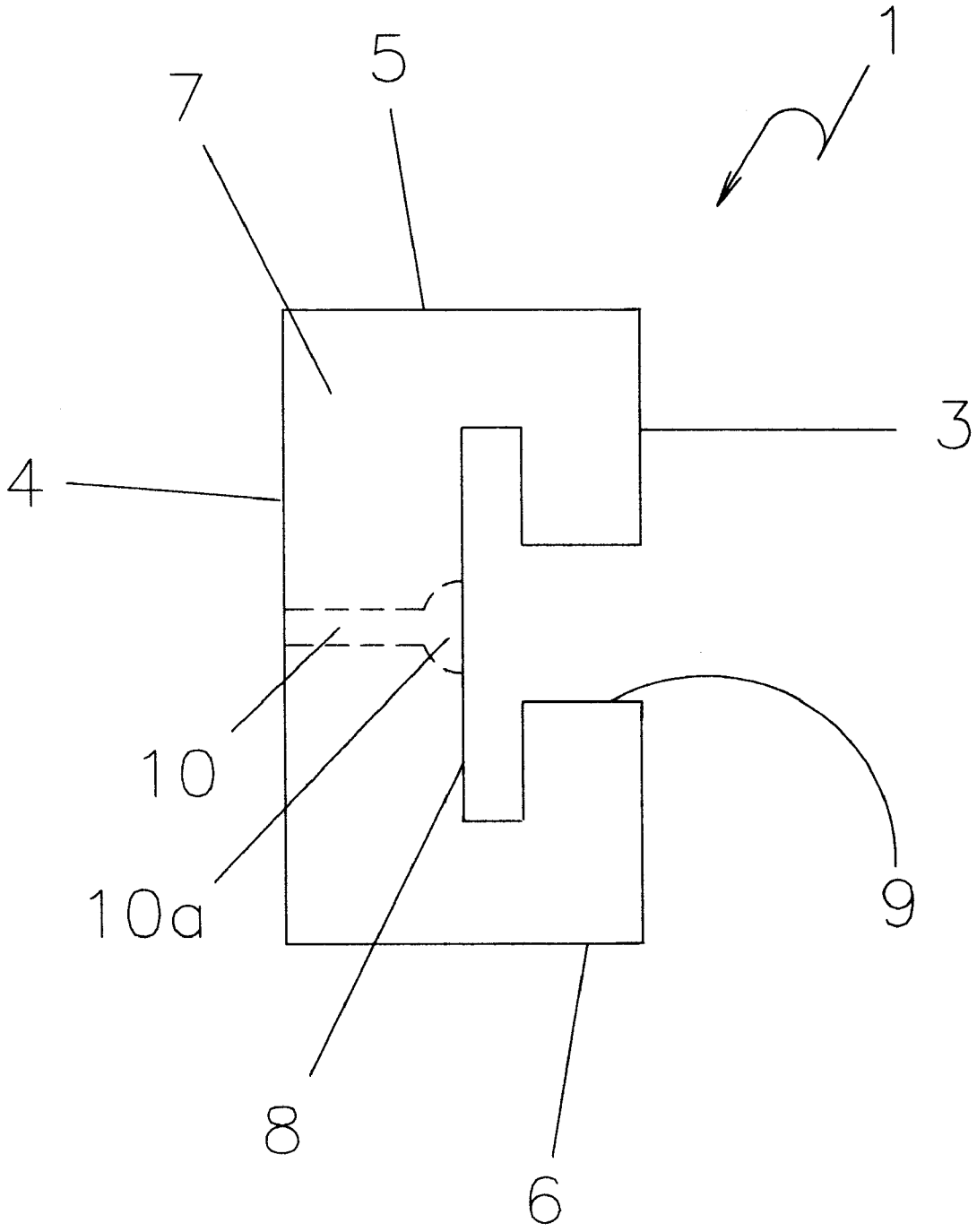
FIG. 2*a* is a side elevational view of the base member of another embodiment of the invention.

If bore holes 10 are used, preferably, bore holes 10 are placed 16 or 24 inches apart to accommodate standard building code requirements for placement of studs and joists in walls and ceilings, respectively. In an alternate embodiment, as shown in FIG. 2*a*, bore holes 10 and counter bores 10*a* can be situated in the bottom of channel 2 for aesthetic purposes.

Figure 1B:
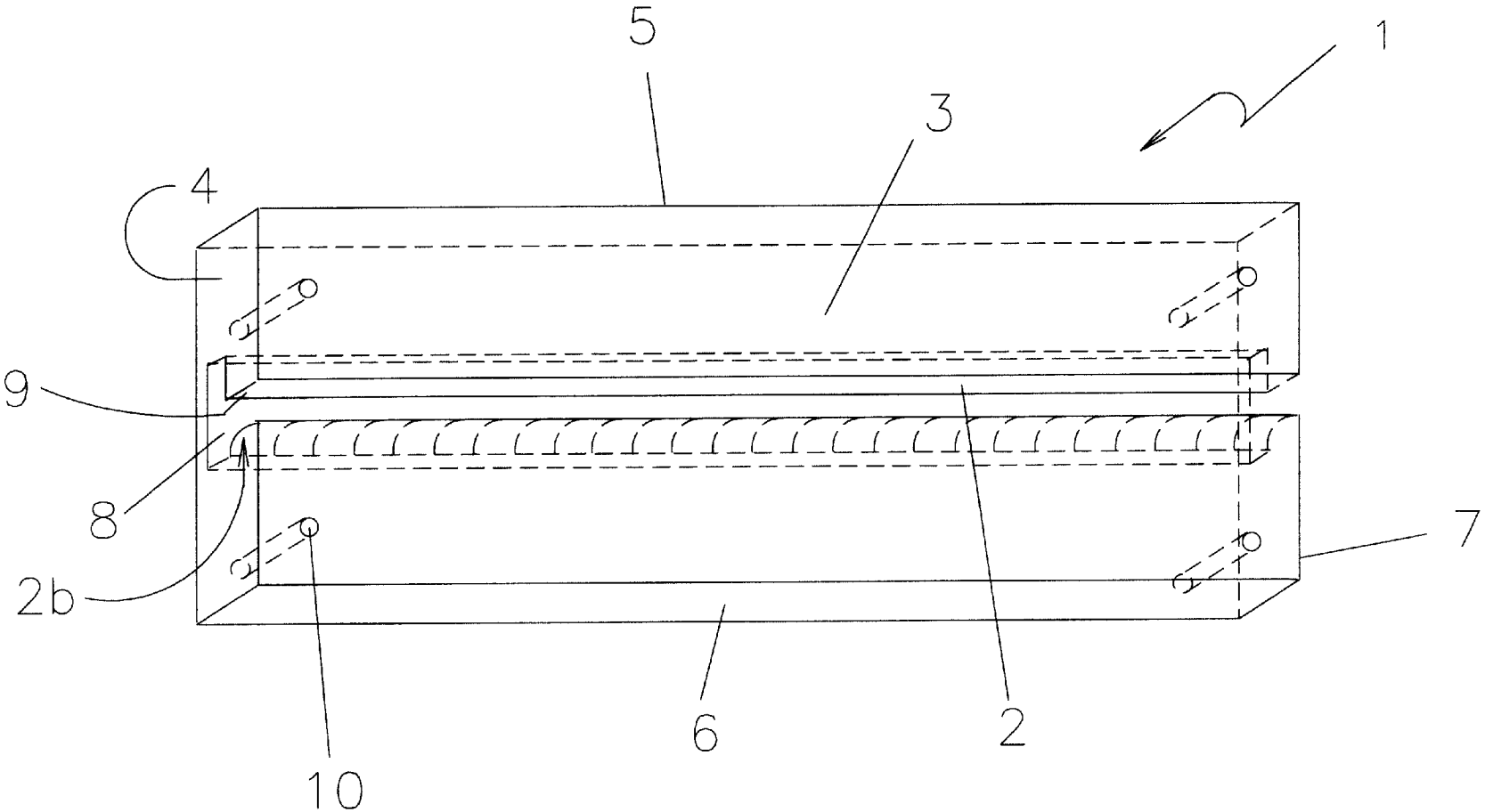
FIG. 1*b* is a front perspective view of the base member of yet another embodiment of the invention.

Channel 2 preferably extends the entire length of base member 1 and is open on both sides 7 and front surface 3. Channel 2 does not have to open on both sides 7 but must be open on at least one side 7 to allow the addition of further elements of the invention to the base member 1. The additional elements are described below. However, as shown in FIG. 1*a,* channel 2 can have a lower flange 2*a* that is chamfered to allow front insertion of a hanging element (not shown) to thereby eliminate the need for channel 2 to have an open end. Alternatively, as shown in FIG. 1*b,* channel 2 can have a lower flange 2*b* that is radiused to accommodate front insertion of a hanging element (not shown) to thereby again eliminate the need for channel 2 to have an open end.

Channel 2 has portions which define two distinct sections. A first section 8 is positioned towards the center of base member 1 relative to a second section 9 which is positioned to open on front surface 3. First section 8 is preferably rectangular in cross-sectional shape. In practice, the sections can be made to conform to any desired shape, including regular and irregular geometric shapes, as long as the length dimension of first section 8, which is the dimension that runs along the plane between the top surface 5 and bottom surface 6, is greater in length than the length dimension of second section 9.

There are at least two methods that can be used to make channel 2. Channel 2 can be formed by routing out base member 1 with an appropriately shaped and sized router bit to cut both cavities in one application or two router bits, one to form first section 8 and another to form second section 9. If router bits having the desired shape and size cannot be found, channel 2 can also be made by making base member 2 out of three different pieces of an appropriate material such as wood. Of course, base member 2 could also be made out of metal or a suitable grade of plastic material.

Figure 3:
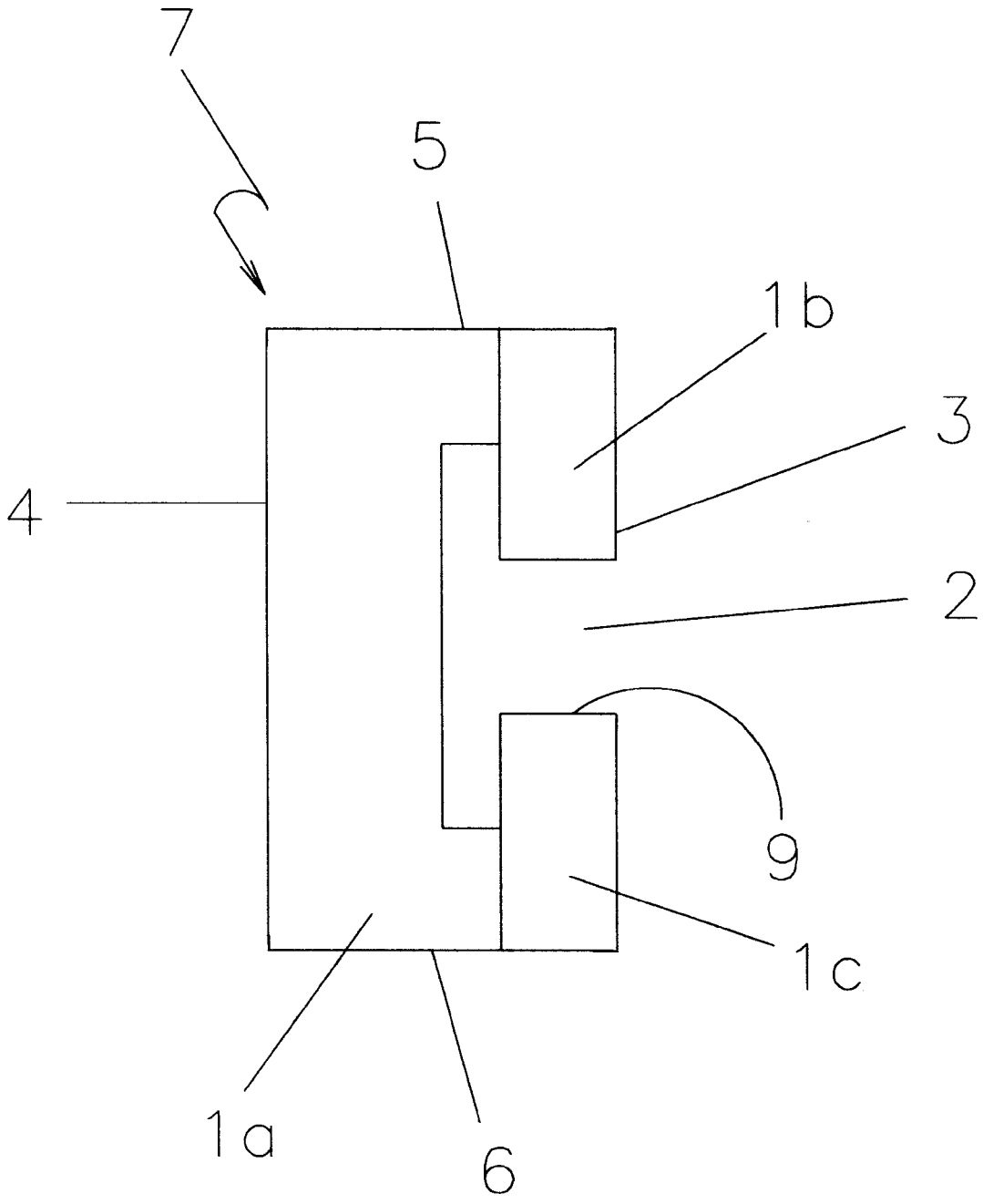
FIG. 3 is a side elevational view of the base member of one embodiment of the invention.

Referring to FIG. 3, base member 1 consists of three distinct pieces of material, a bottom member 1*a,* a top upper member 1*b,* and a top lower member 1*c*. To make first section 8 of channel 2, a rectangular groove is made on a top surface of bottom member 1*a*. The depth of the groove is set to extend only partially through the thickness of bottom member 1*a*. If wood is used, the groove can be made with a dado blade on a table saw or radial arm saw. After first section 8 has been formed, top upper member 1*b* and top lower member 1*c* are secured with adhesive, mechanical fasteners, or other suitable means, to the top surface of bottom member 1*a* so that adjacent edges of 1*b* and 1*c* partially overlap first section 8.

The opposing edges of top upper member 1*b* and top lower member 1*c* are in alignment with the respective edges of bottom member 1*a*. The width of upper member 1*b* and lower member 1*c* are preferably equal and are such that when aligned with the respective edges of bottom member 1*a,* a gap exists between the adjacent edges of top upper member 1*b* and top lower member 1*c* thereby forming second section 9.

Figure 3A:
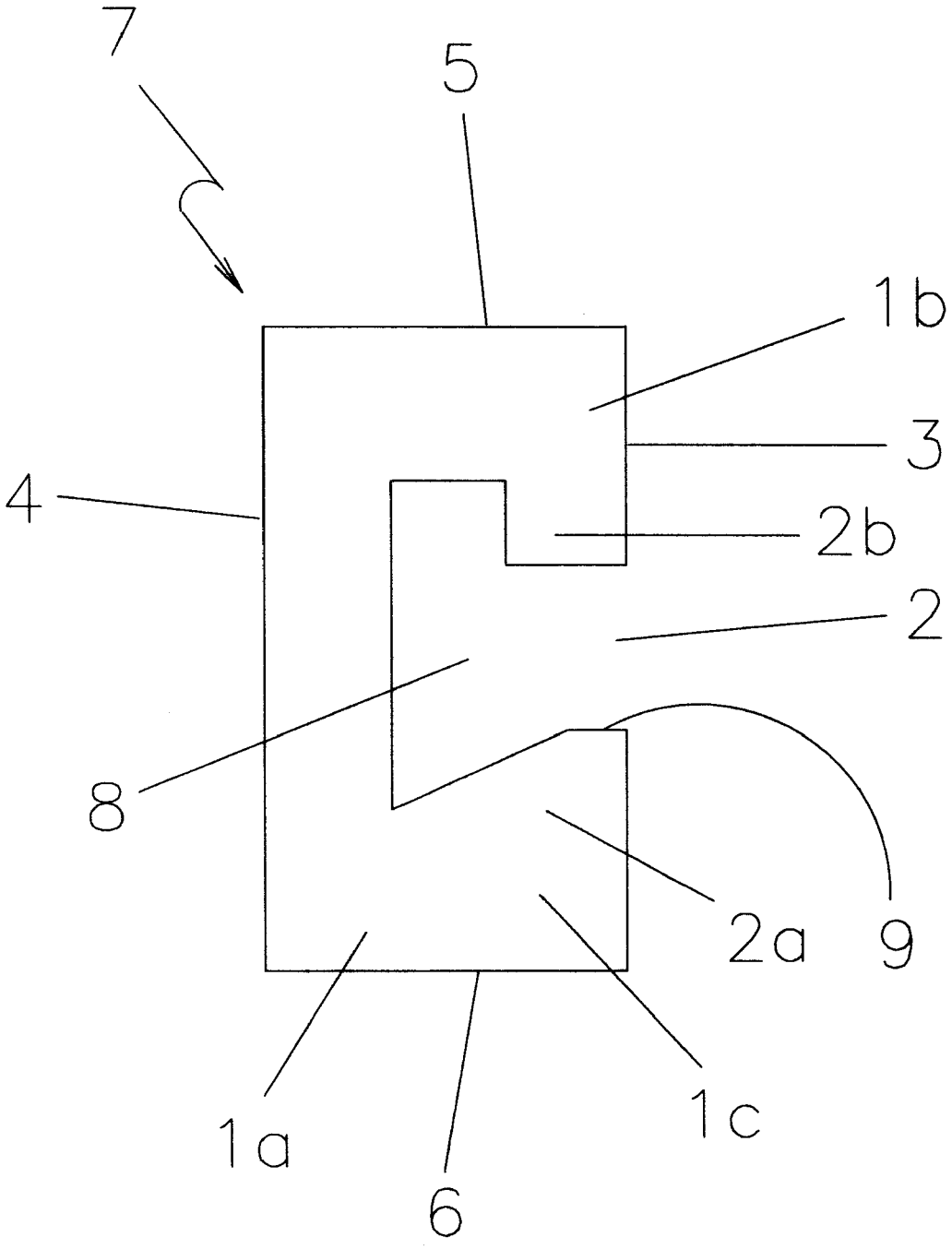
FIG. 3*a* is a side elevational view of the base member of another embodiment of the invention.
Figure 3B:
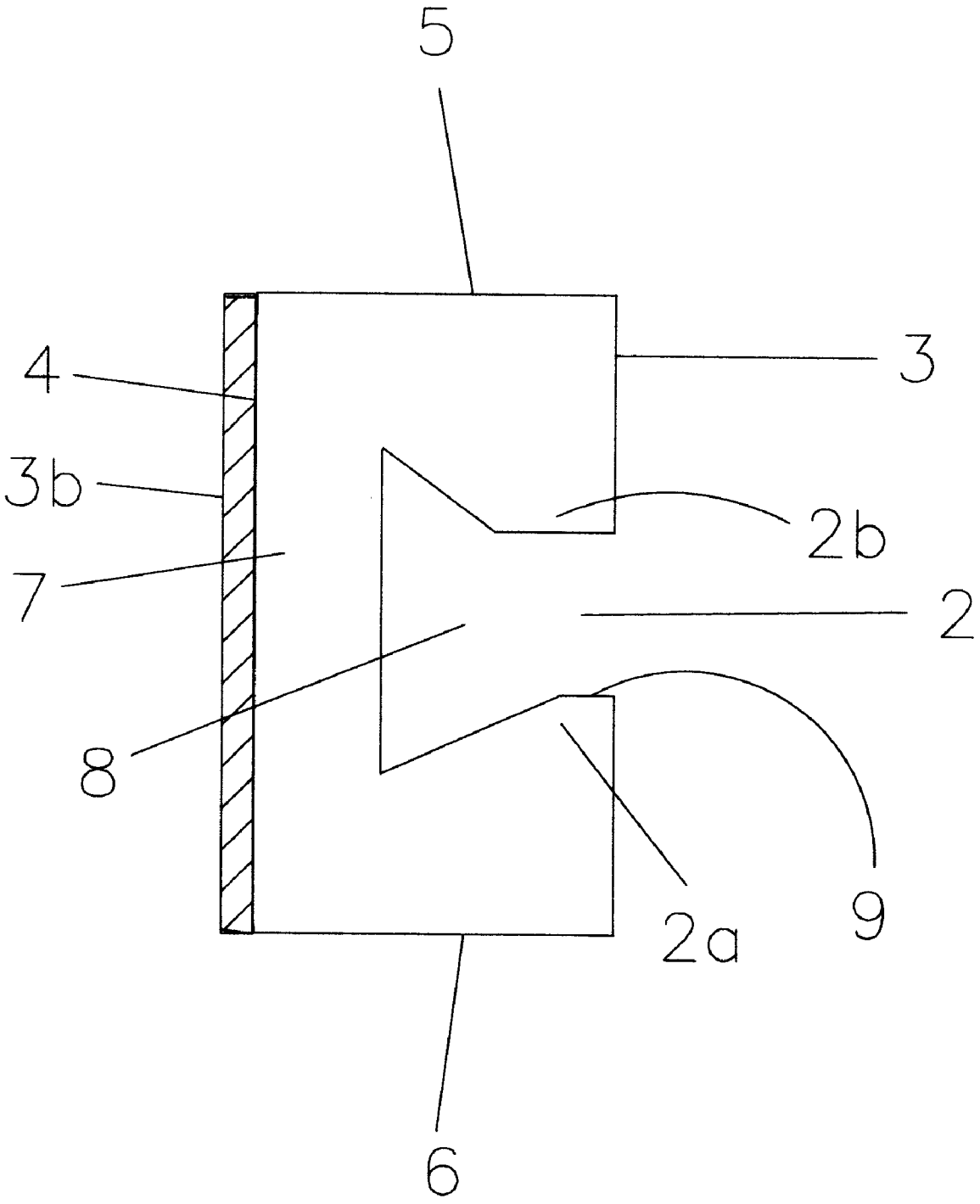
FIG. 3*b* is a side elevational view of an embodiment of the base member with adhesive.

As shown in FIG. 3*a*, channel 2 can have a lower flange 2*a* that is chamfered to allow front insertion of a hanging element. If a chamfer is used, the only criteria with respect to front insertion of hanging elements is that the hanging elements have bases that are no thicker than the smallest distance between lower flange 2*a* and upper flange 2*b*.

Figure 4:
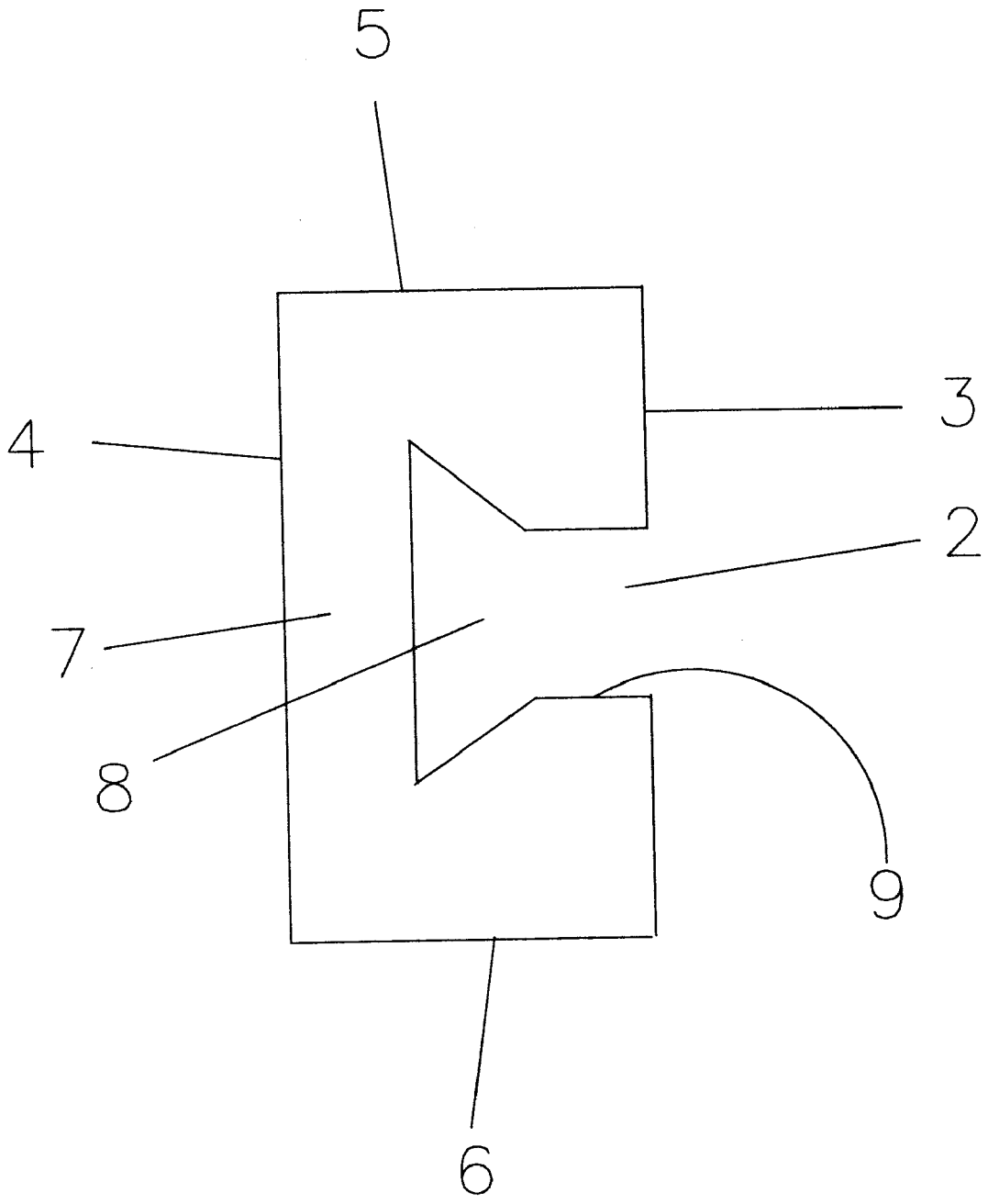
FIG. 4 is a side elevational view of the base member and first channel of an alternate embodiment of the invention.

In another embodiment, referring to FIG. 4, channel 2 in base member 1 has first section 8 having a frusto-conical shape also known as a dovetail shape. First section 8 with the frusto-conical shape can be formed by either of the two means described above.

Figure 5:
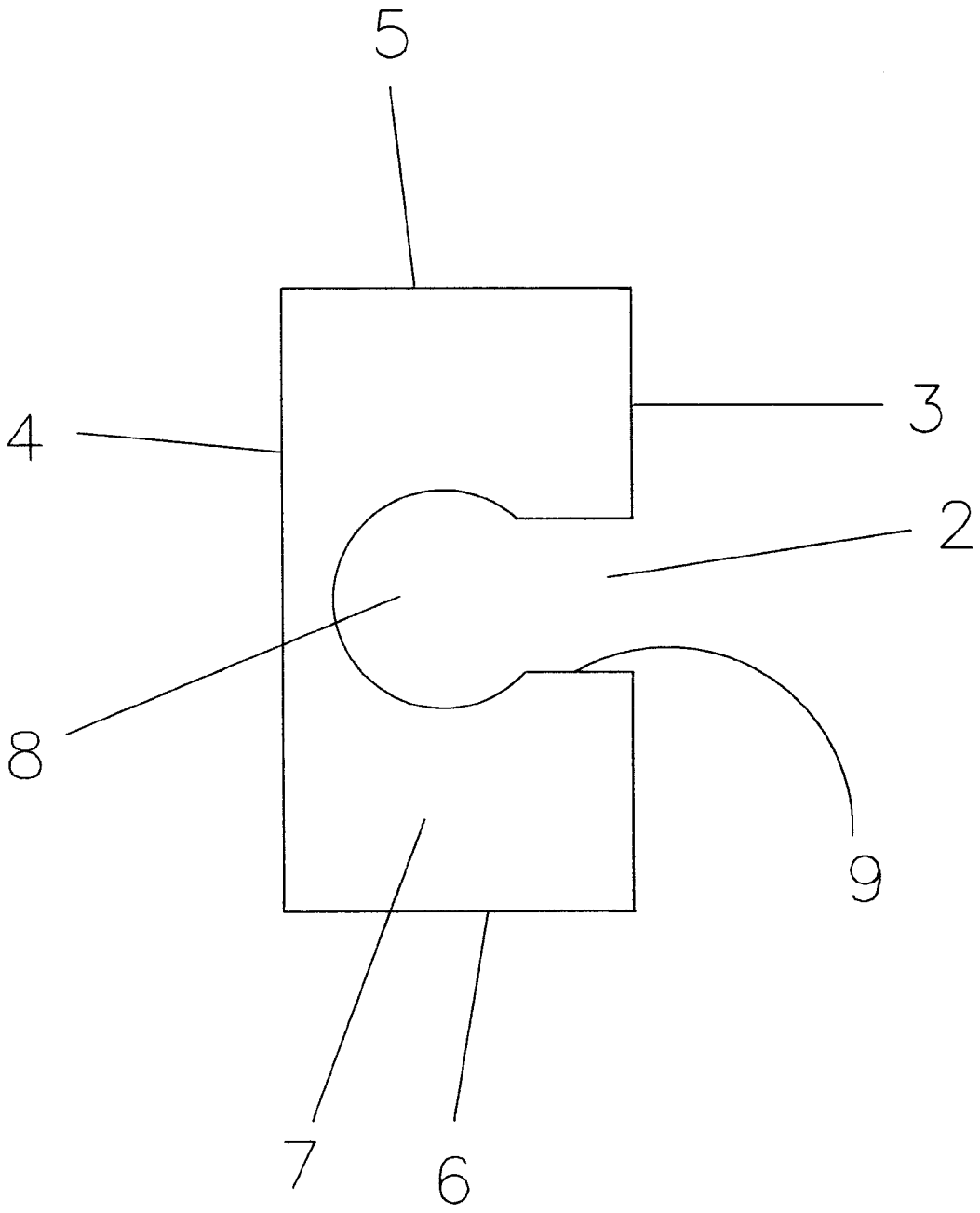
FIG. 5 is a side elevational view of the base member and first channel of a further alternate embodiment of the invention.

In a still further embodiment, referring now to FIG. 5, channel 2 in base member 1 has first section 8 having a spherical shape. The diameter of first section 8 is preferably the diameter of a standard closet pole, 1.25 inches or 1.625 inches.

Base member 1 is designed to be secured to a support surface such as a wall or a ceiling. If desired, base member 1 can also be secured to a primary support surface that is, in turn, secured to the wall or ceiling support surface. For example, base member 1 could be made out of a metal and could be secured to a wooden plaque or board, which is then secured to a wall. If desired, tertiary or even quaternary support surfaces could be used depending on the particular application.

Figure 4A:
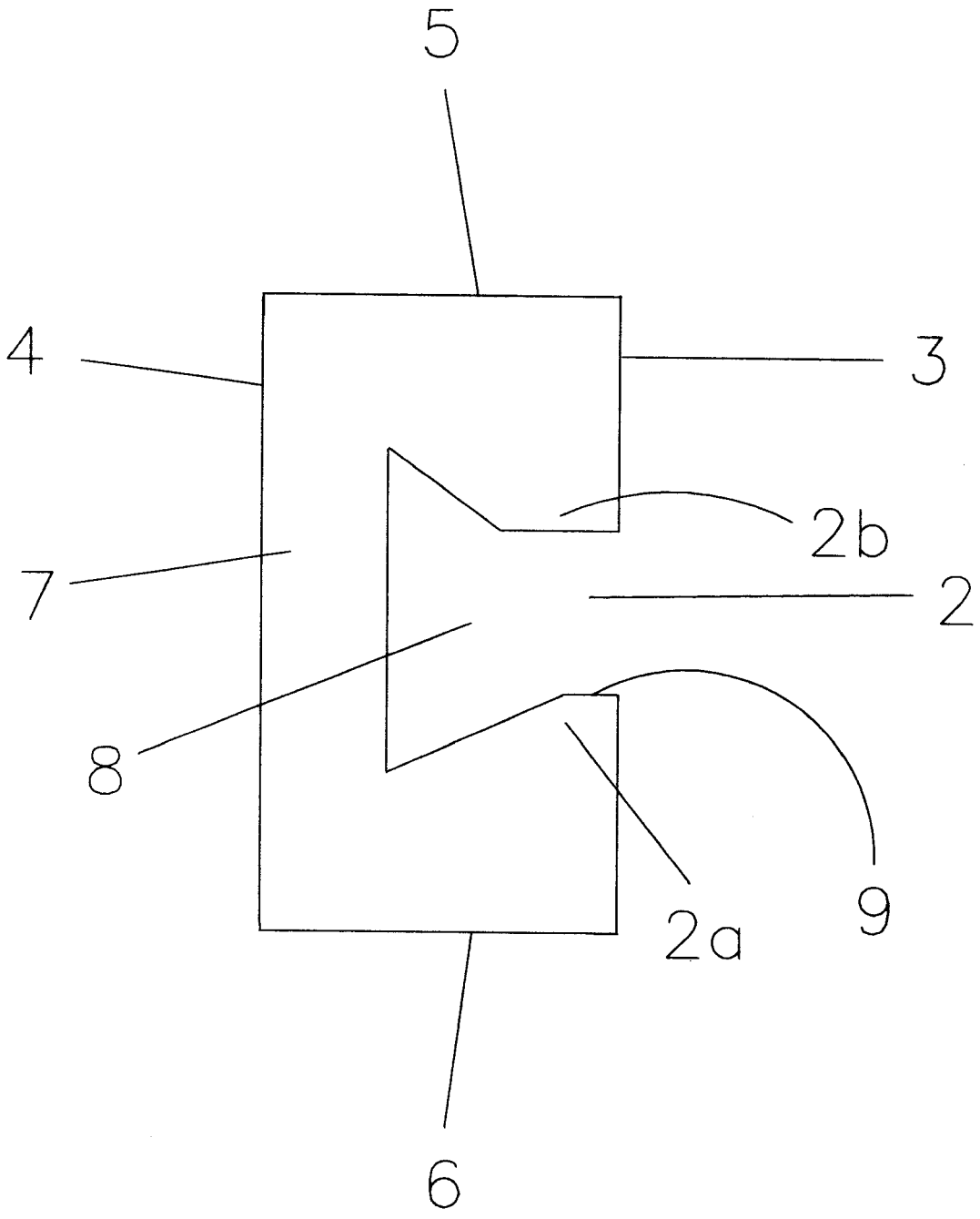
FIG. 4*a* is a side elevational view of the base member and first channel according to one embodiment of the invention.
Figure 5A:
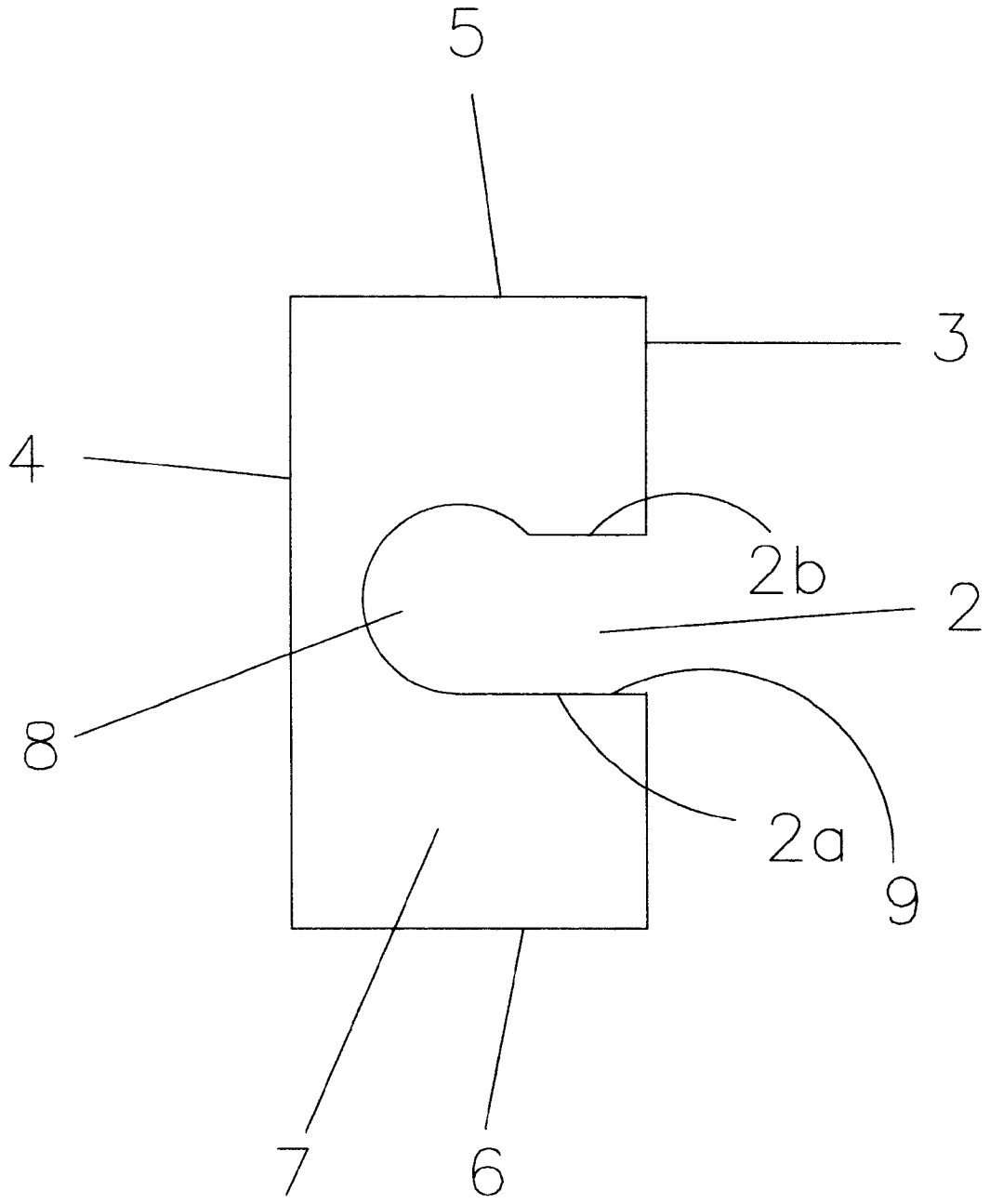
FIG. 5*a* is a side elevational view of the base member and first channel according to one embodiment of the invention.

As shown in FIGS. 4*a* and 5*a*, the alternate embodiments shown in FIGS. 4 and 5 can have either upper flanges (not shown) or lower flanges 2*a* (shown) that are modified to form irregular second section 9 openings to allow front insertion of hanging elements.

Figure 6:
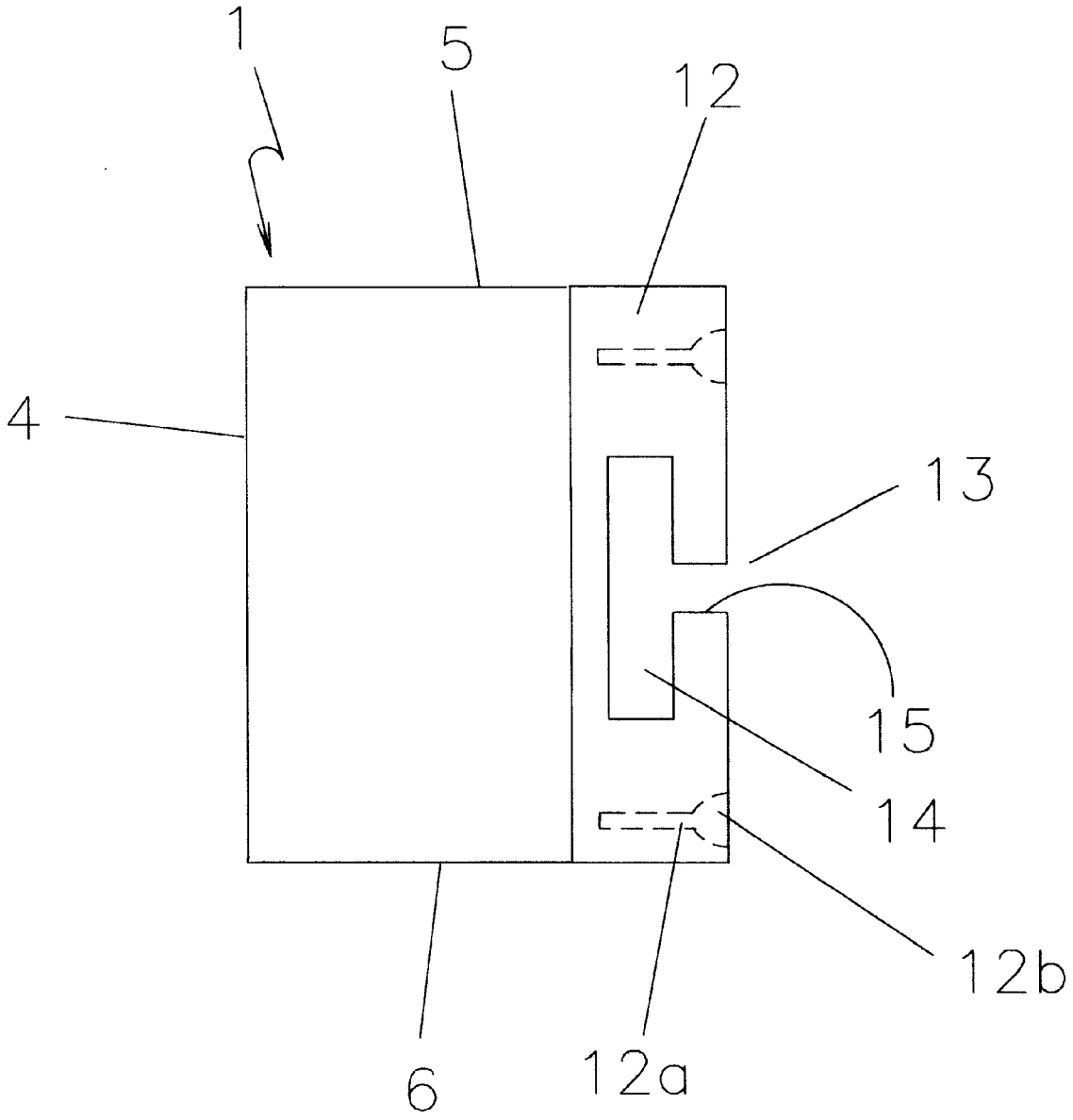
FIG. 6 is a side elevational view of the base member and first channel of a still further alternate embodiment of the invention.

An example of base member 1 being used as a primary support surface is shown in FIG. 6. In this embodiment, base member 1 is made without channel 2 to function as a primary support surface for a top member 12 having a channel 13. The combination of base member 1 and top member 12 is then secured to a support surface such as a wall or ceiling. Top member 12 has bore holes 12*a* and counterbores 12*b* concentric with bore holes 12*a* through both of which mechanical fasteners such as screws or bolts can be used to secure top member 12 to base member 1. Top member 12 can also be secured to base member 1 with an appropriate adhesive or other securing means such as spot welding if base member 1 and top member 12 are made of metal materials.

Like channel 2, channel 13 has portions which define two distinct sections. A first section 14 is positioned towards the center of top member 12 relative to a second section 15 which is positioned to open on a front surface of top member 12.

First section 14 is preferably rectangular in cross-sectional shape and has a length that is greater than the length of second section 15. In practice, the sections can be made to conform to any desired shape as long as the length dimension of first section 14, the dimension that runs along the plane between a top surface of top member 12 and a bottom surface of top member 12, is greater in length than the length dimension of second section 15.

Like base member 1, top member 12 can be made of any suitable material such as wood, metal, or plastic. The shape of channel 13 can be made by any of the means described to make channel 2. Preferably, but not necessarily, channel 13 extends the entire length of top member 12.

Figure 7:
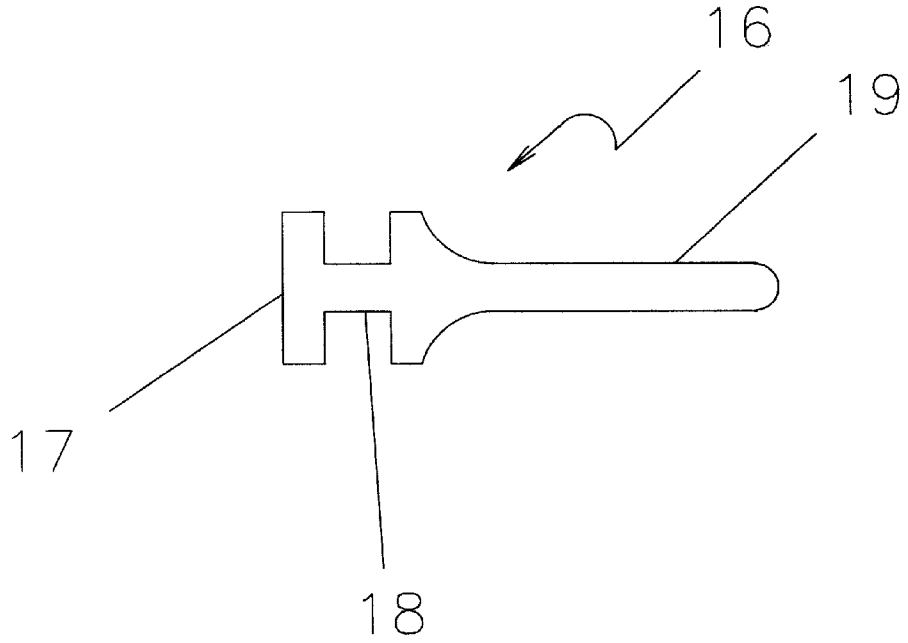
FIG. 7 is a side view of the hanging element of one embodiment of the invention.

Referring to FIG. 7, it can be seen that hanging element 16 has a base portion 17, a neck portion 18, and a top portion 19 in one embodiment. Base portion 17 is shaped and sized to slideably and matingly engage the walls of first section 8 in base member 1 or first section 14 in top member 12.

Figure 25:
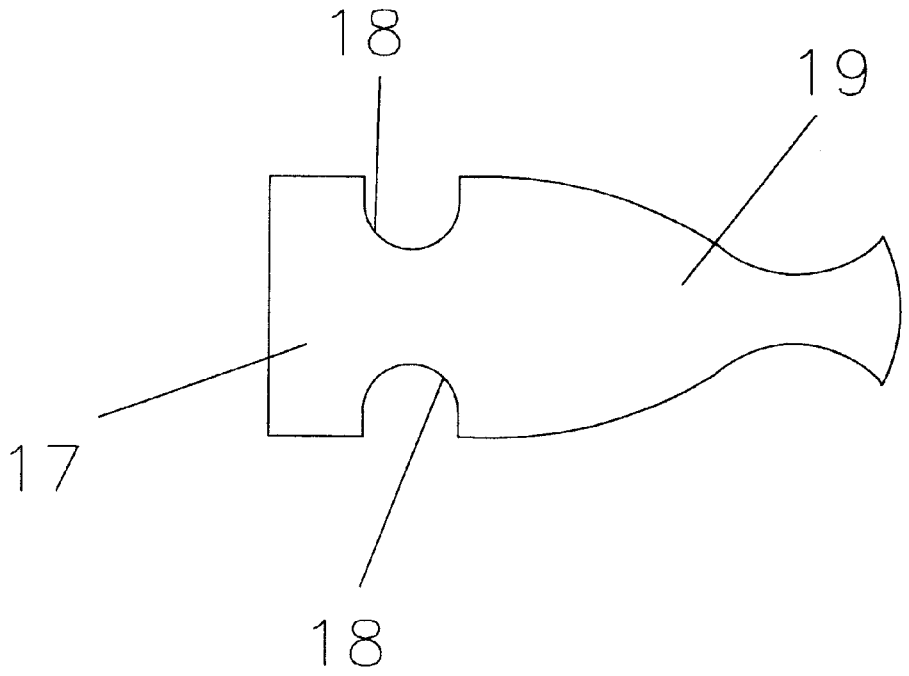
FIG. 25 is a side view of a hanging element according to one embodiment of the invention.

Neck portion 18 is shaped and sized to matingly and slidingly engage the walls of second section 9 in base member 1 or second section 15 in top member 12. If wood is the material used to make hanging element 16, it has been found that providing neck portion 18 with a radiused profile (as shown in FIG. 25) with respect to the bottom portion 17/neck portion 18 and top portion 19/neck portion 18 interfaces prevents separation of neck portion 18 from either bottom portion 17 or top portion 19 when a load is placed on hanging element 16.

Top portion 19 is designed to project from front surface 3 of base member 1 or the front surface of top member 12. Preferably, top portion 19 has a flange at a bottom end of top portion 19 that engages front surface 3 of base member 1 or the front surface of top member 12 to accommodate the force generated by an article suspended on top portion 19 of hanging element 16.

Figures 8A, 8B, 8C:
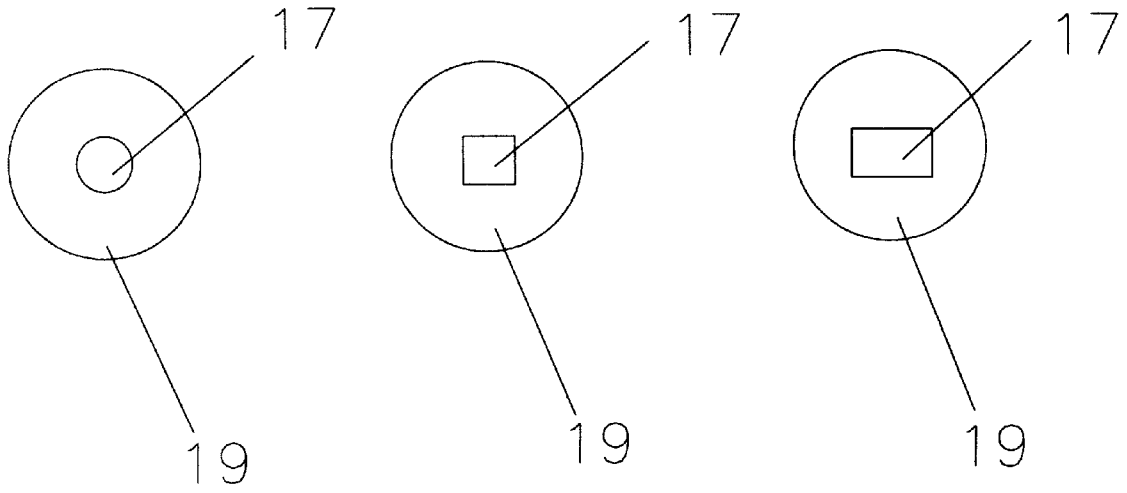
FIG. 8*a* is a top end view of the hanging element of one embodiment of the present invention.
FIG. 8*b* is a top end view of the hanging element of another embodiment of the present invention.
FIG. 8*c* is a top end view of the hanging element of a further embodiment of the present invention.

As shown in FIG. 8*a*, top portion 19 can be formed in the shape of a rod, a rectangle with a square cross-sectional shape as shown in FIG. 8*b* or a rectangular cross-sectional shape as shown in FIG. 8*c*, or any other regular or irregular geometric shape. The cross-sectional shape can also be any regular or irregular geometric shape.

Figure 9:
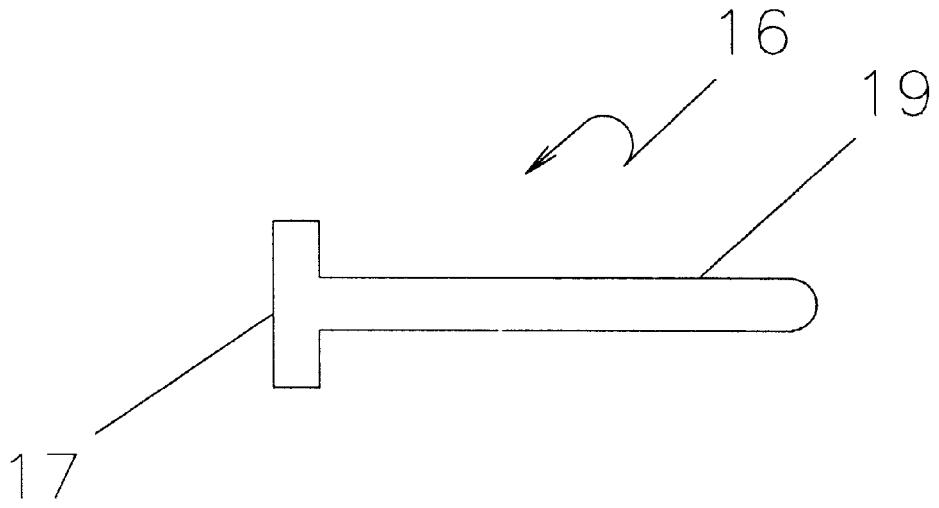
FIG. 9 is a side view of the hanging element of another embodiment of the invention.

As seen in FIG. 9, hanging element 16 can be formed without a neck portion 18 and with a top portion 19 that does not have a flange. However, in this embodiment, the outside dimensions must be set to accommodate sliding and mating engagement with second section 9. If hanging element 16, in this embodiment, is used in combination with top member 12, the outside dimensions must be set to accommodate sliding and mating engagement with second section 15.

Figure 10:
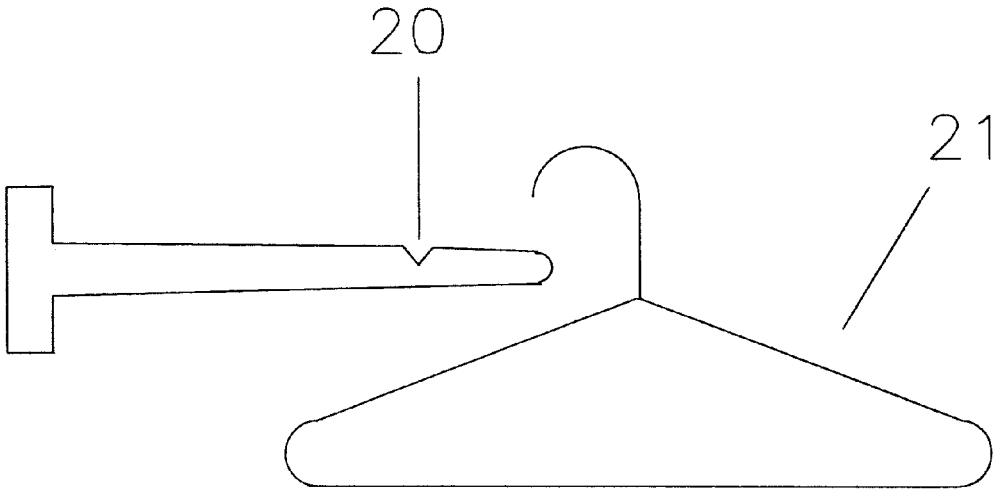
FIG. 10 is a side view of the hanging element of a further embodiment of the invention shown with a cloths hanger.

As shown in FIG. 10, top portion 19 can have a notch 20. Notch 20 can be used, for example, to restrict the movement of a cloths hanger 21 when placed on hanging element 16. This allows placement of the present invention on support surfaces that are not located or oriented in a plane normal to the floor or ground.

Figure 11:
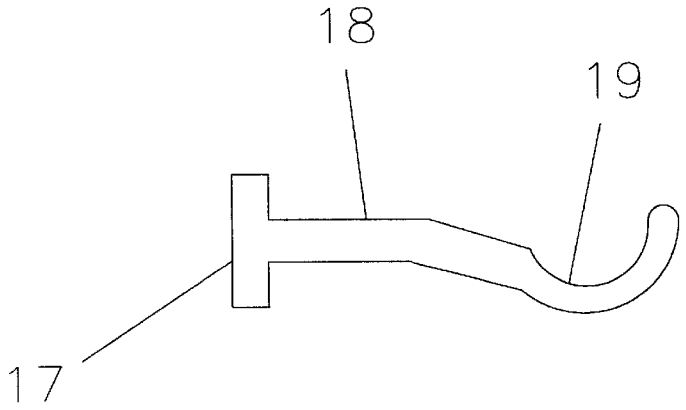
FIG. 11 is a side view of the hanging element of a still further embodiment of the present invention.

Turning to FIG. 11, the top portion 19 of hanging element 16 can be shaped to conform to the shape of a hook. With the appropriate size and shape of the hook-shaped embodiment of top portion 19, the present invention can be used as a means to organize and store items on vertical as well as horizontal support surfaces such as ceilings.

Figure 20:
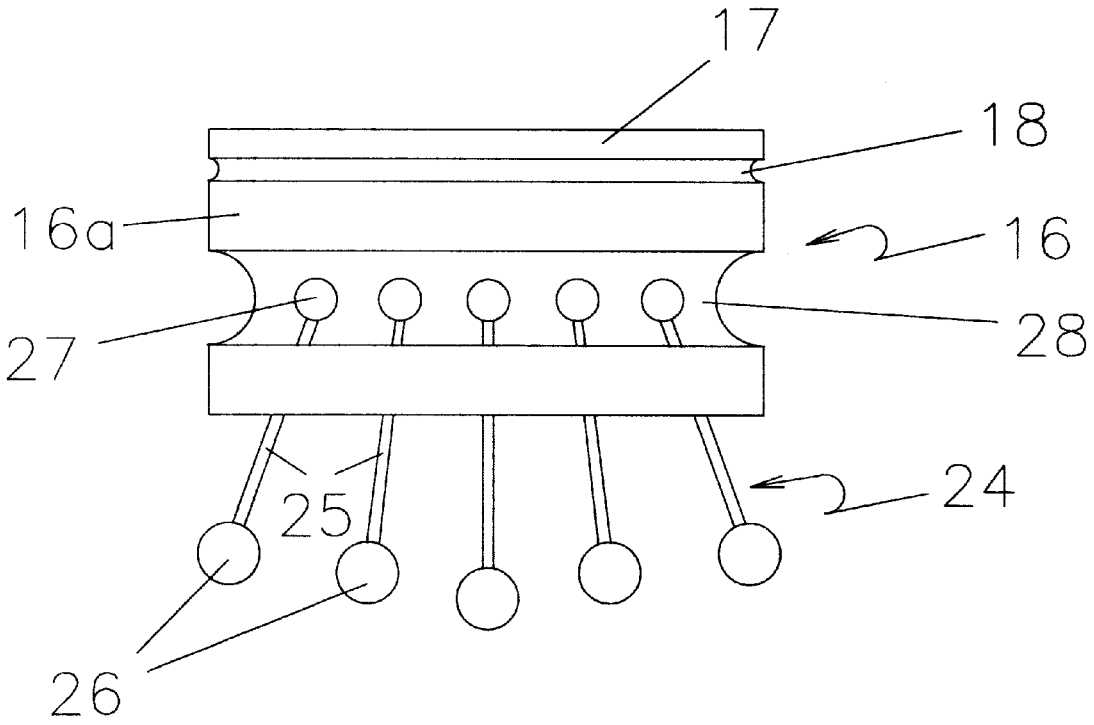
FIG. 20 is a bottom view of a multi-arm retractable hanging element according to one embodiment of the invention.

Different alternate embodiments for hanging element 16 is shown in FIGS. 20–24 and 26–34. Referring to FIG. 20, a bottom side of a multi-arm retractable hanging element is shown. In the embodiment shown, hanging element 16 is comprised of a hanging element body 16*a* and a plurality of retractable arms 24. Hanging element body 16*a* has a main channel 28 on its bottom side that is configured to releasably and matingly engage internal ball end 27 of retractable arm 24. Hanging element body 16*a* has a neck portion 18 that is adjacent to bottom portion 17.

Figure 21:
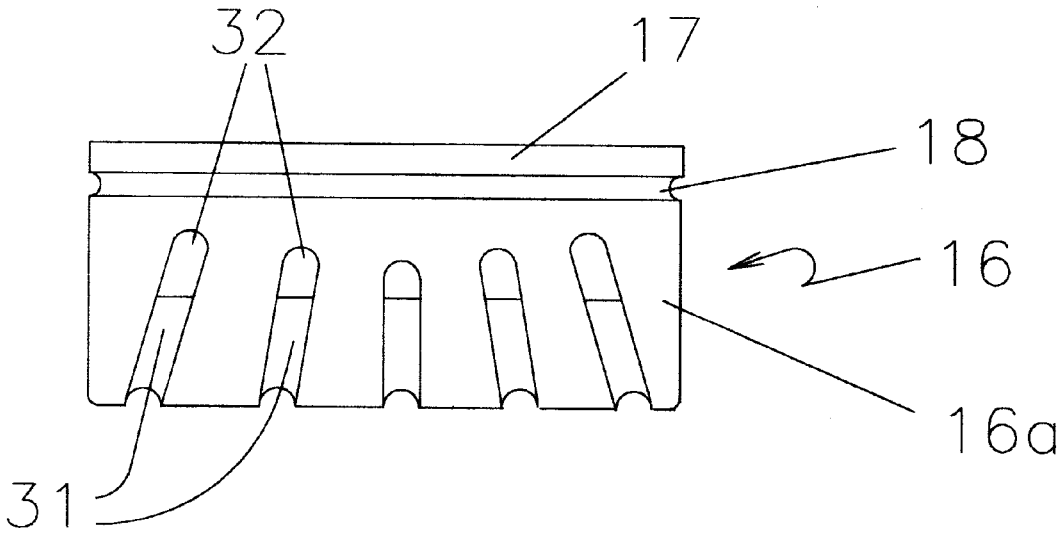
FIG. 21 is a top view of a multi-arm retractable hanging element base member according to one embodiment of the invention.
Figure 32:
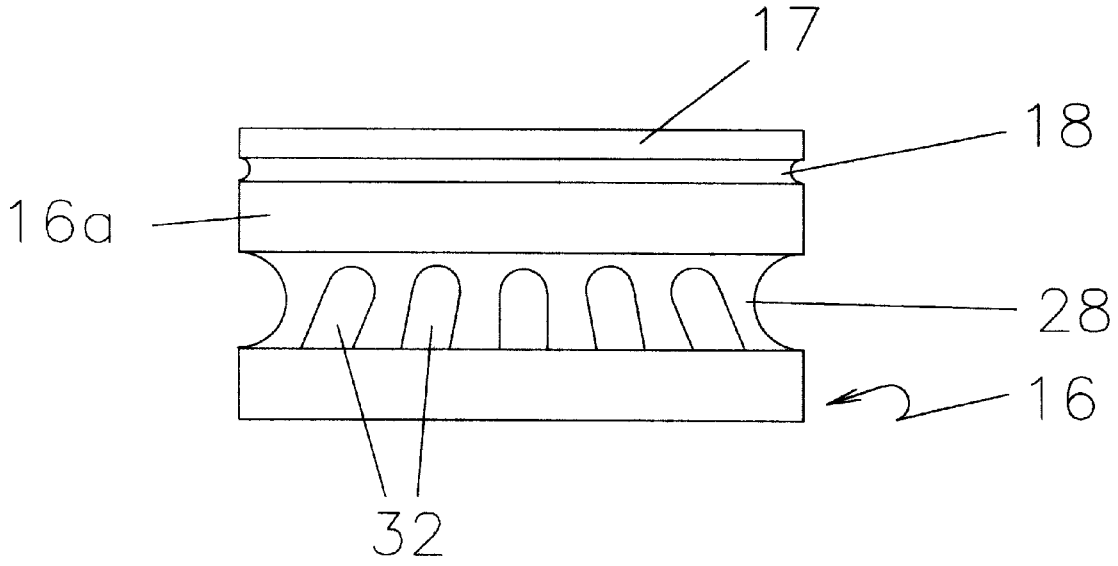
FIG. 32 is a bottom view of a multi-arm retractable hanging element base member according to one embodiment of the invention.

Referring to FIG. 21, a top side view of hanging element body 16*a* is shown. On its top side, hanging element body has radial channels 31 which are configured to releasably and matingly engage retractable arm shaft 25 of retractable arm 24. Apertures 32 are formed from the juncture of main channel 28 and radial channels 31 as shown in FIG. 32. Apertures 32 are sized to allow sliding engagement with retractable arm shaft 25 and to arrest passage of either an external end ball 26 or internal end ball 27 of retractable arm 24.

Figure 22:
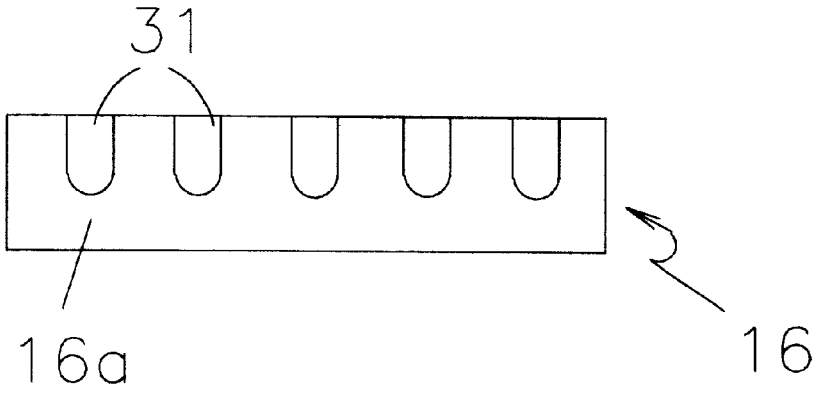
FIG. 22 is an end view of a multi-arm retractable hanging element base member according to one embodiment of the invention.
Figure 23:
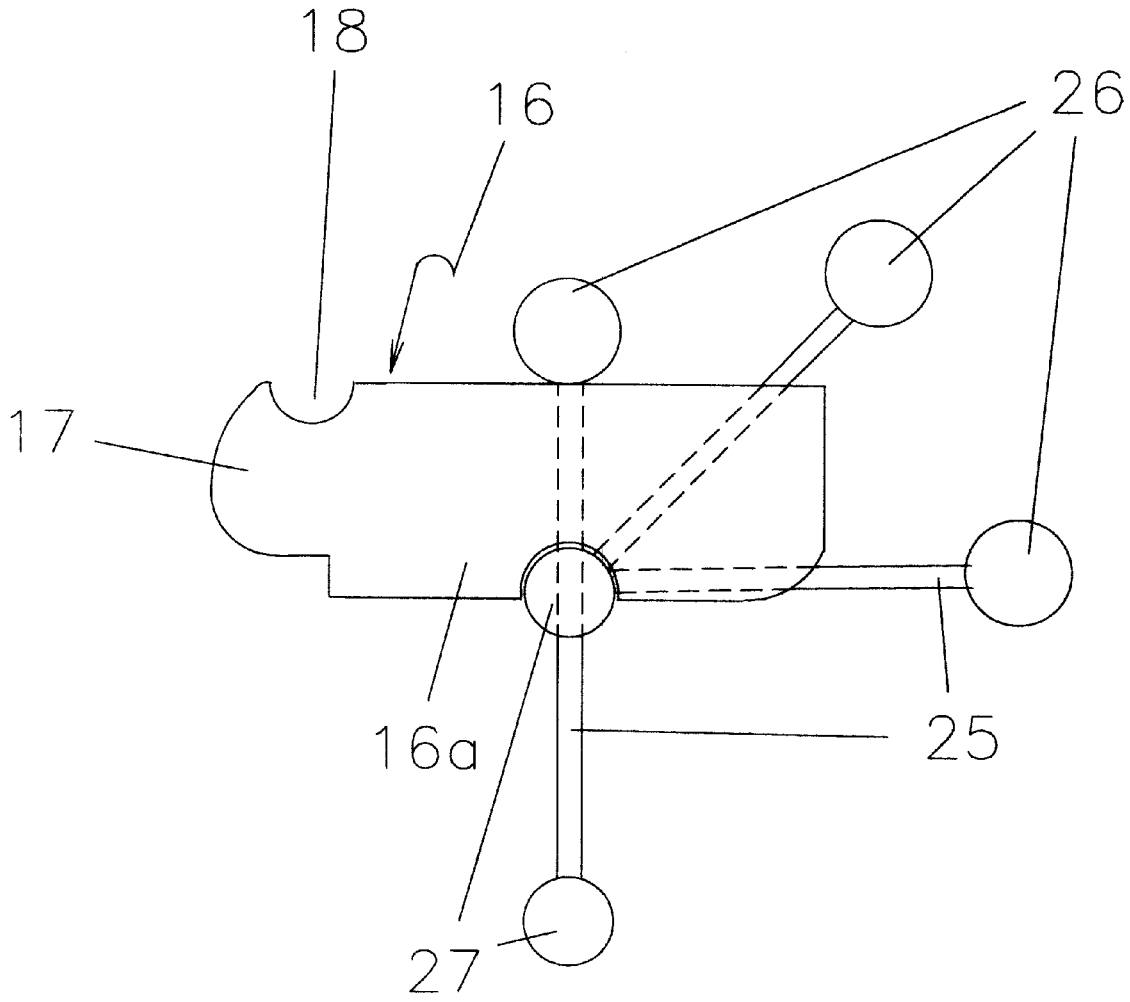
FIG. 23 is a perspective view of a multi-arm retractable hanging element according to one embodiment of the invention.
Figure 24:
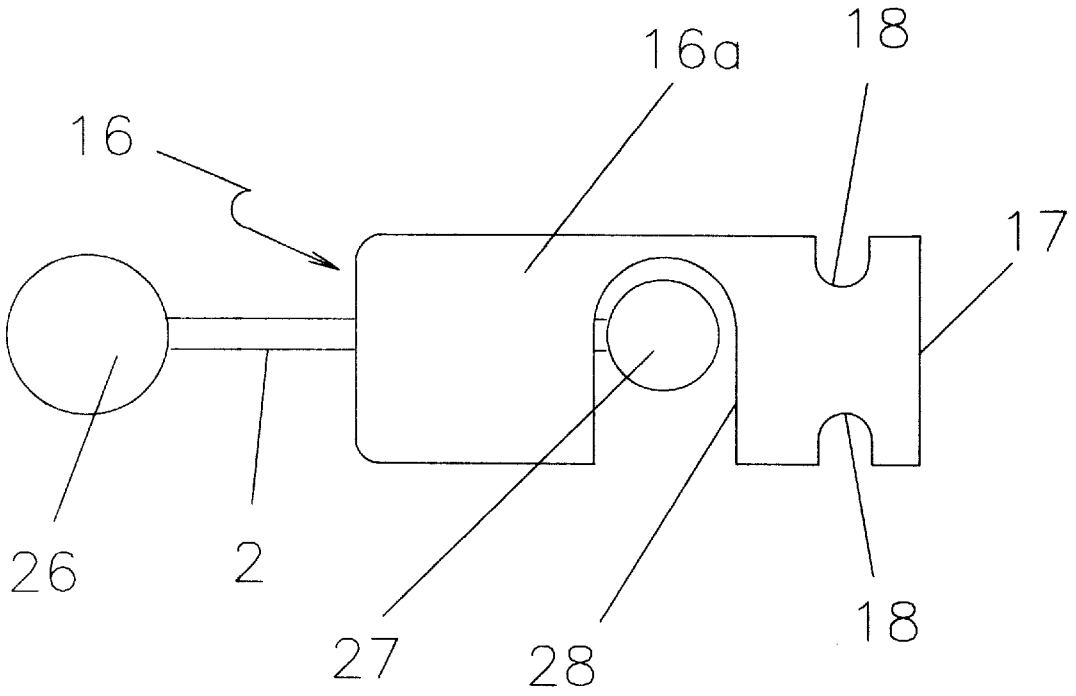
FIG. 24 is a side view of a multi-arm retractable hanging element according to one embodiment of the invention.

FIG. 22 shows an elevational end view of hanging element body 16*a*. As shown, radial channels 31 are open to the top side of hanging element body 16*a* so that retractable arms 24 can be rotated into or out of radial channels 31. When retractable arms 24 are rotated out so that retractable arm shafts 25 occupy a plane normal to the plane occupied by hanging element body 16*a*, retractable arms 24 can slid through apertures 32 until either external end ball 26 comes into contact with the top side of hanging element body 16*a* or internal end ball 27 comes into mating contact with main channel 28 as shown in FIG. 23. FIG. 24 shows retractable arm 24 engaged with main channel 28.

Figure 26:
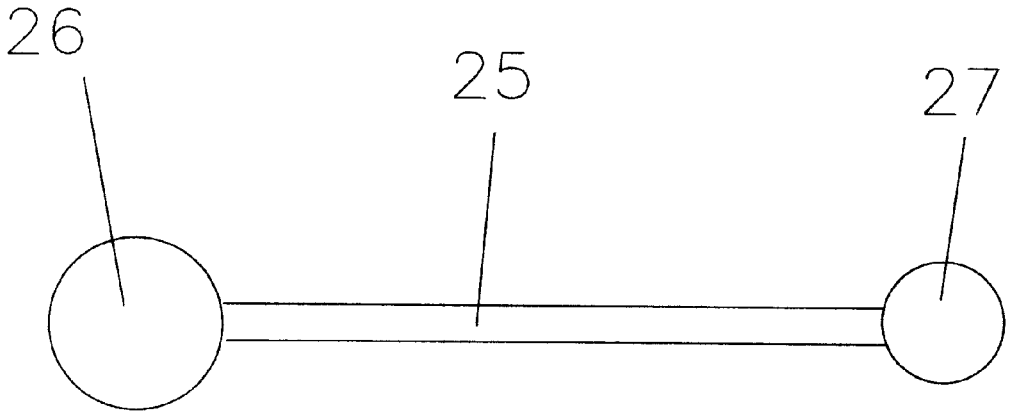
FIG. 26 is a side view of a retractable arm of a multi-arm retractable hanging element.
Figure 27:
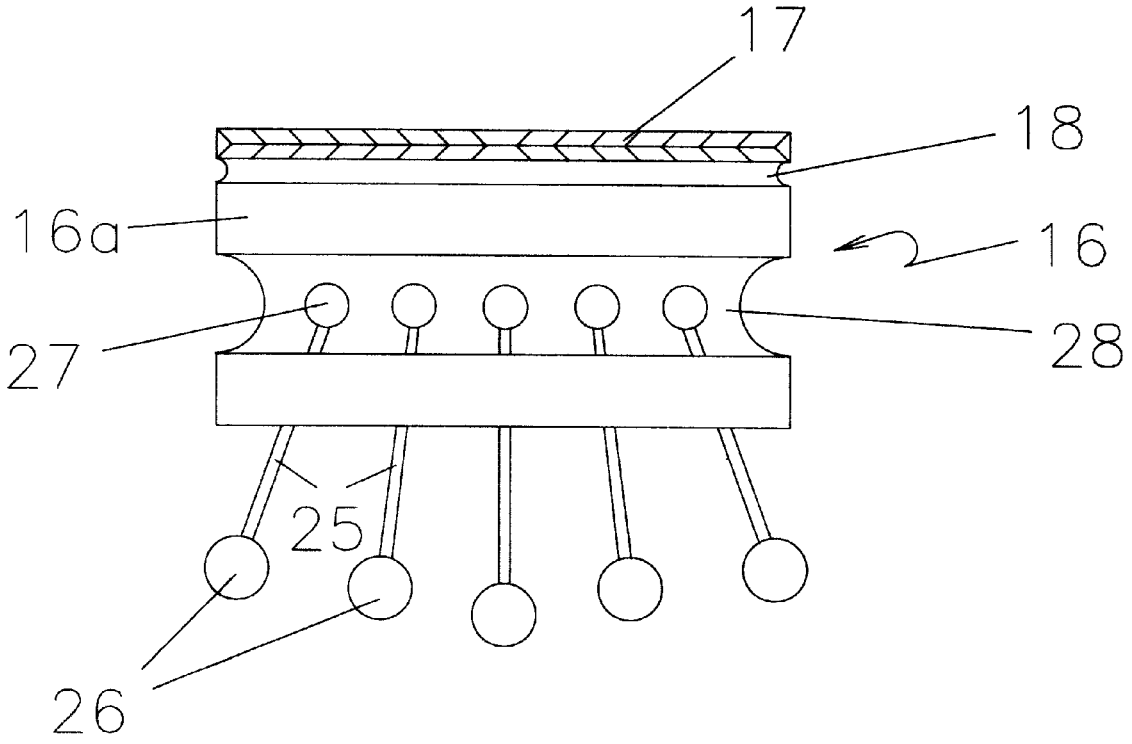
FIG. 27 is a bottom view of a multi-arm retractable hanging element according to another embodiment of the invention.
Figure 28:
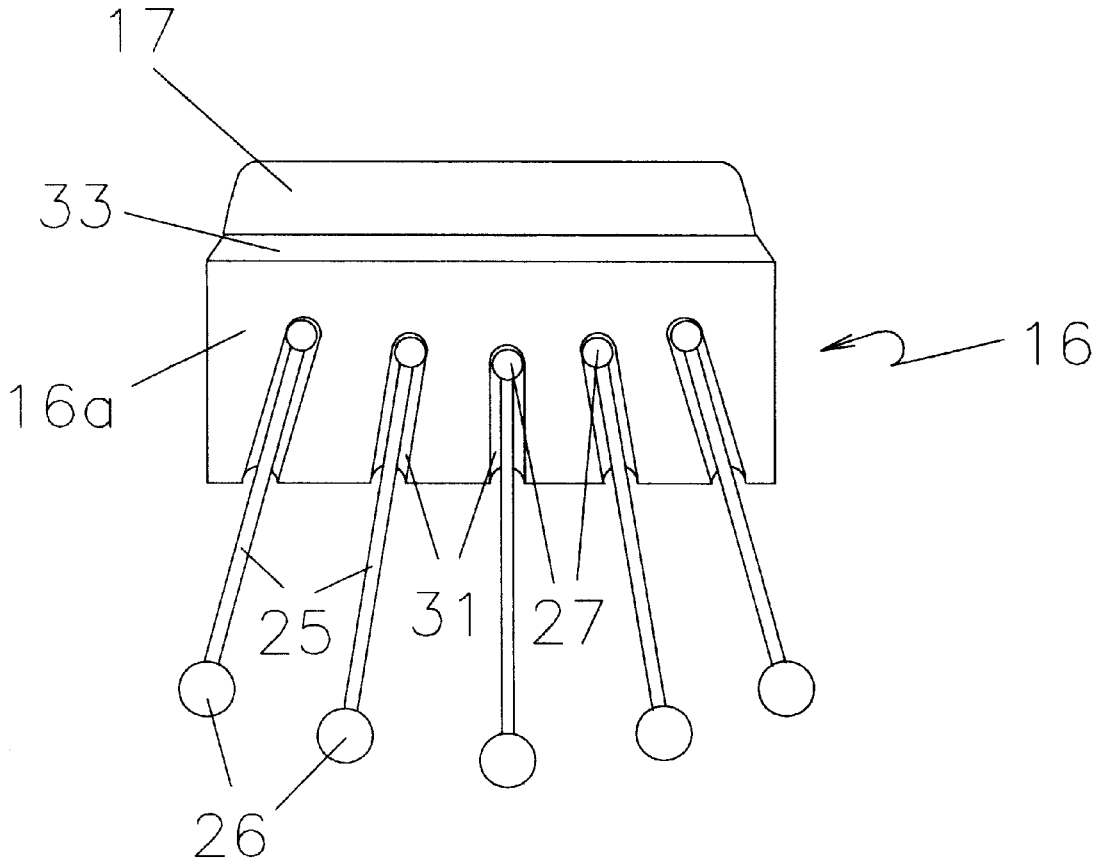
FIG. 28 is a top view of a multi-arm retractable hanging element according to one embodiment of the invention. a FIG. 29 is a top view of multi-arm retractable hanging element according to another embodiment of the invention.
Figure 29:
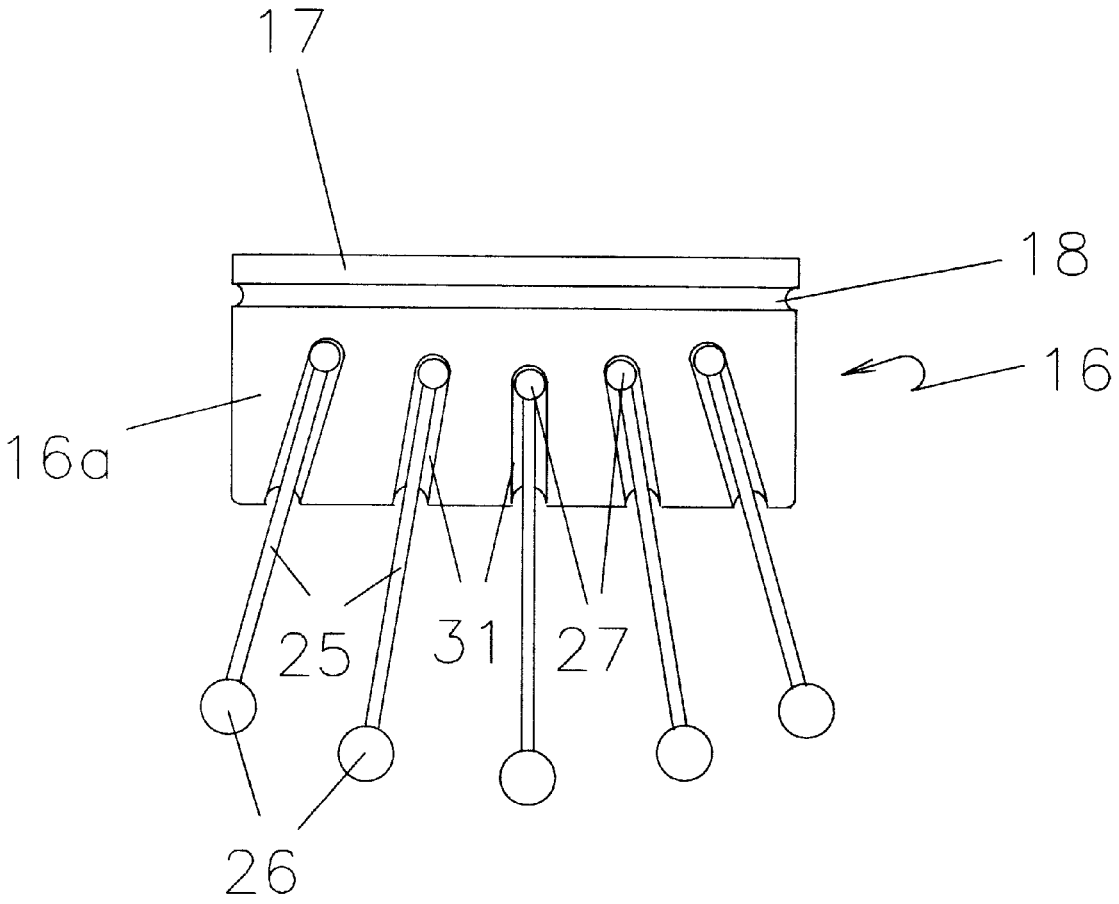

Referring to FIG. 26, a retractable arm 24 is shown with the retractable arm shaft 25, internal ball end 27 and external ball end 26. For purposes of the invention, ball ends 26 and 27 can be made with any diameter so long as internal ball end 27 can engage main channel 28 and has a diameter greater than apertures 32 (as shown in FIG. 29) and external ball end 26 is sufficiently large so that it cannot fit within radial channels 31. If desired, both end balls can have the same diameter so long as the foregoing criteria are met. Alternatively, the end balls can be configured in accordance with any geometric shape provided that the established criteria is met.

Figure 30:
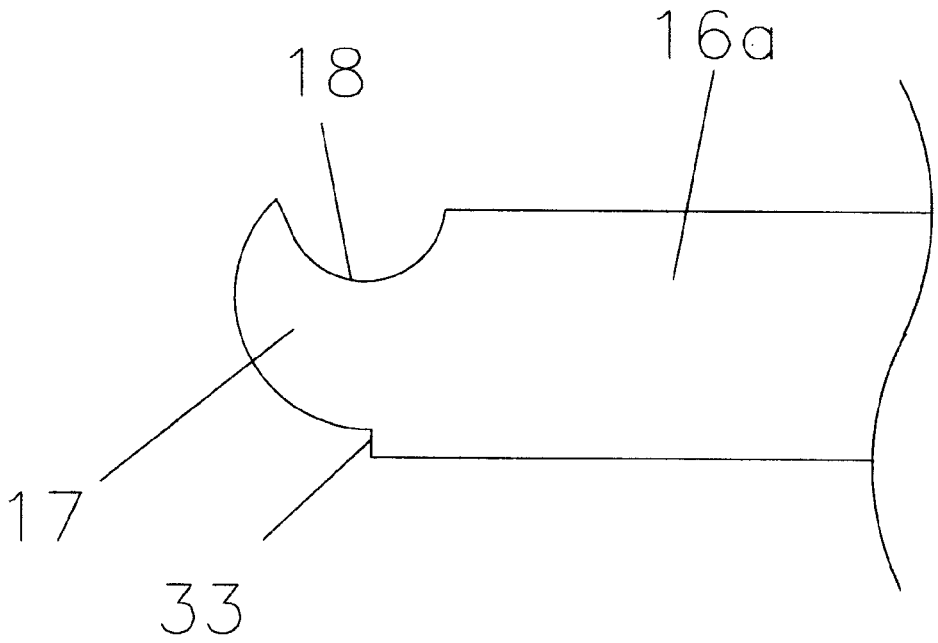
FIG. 30 is a sectional view of a radiused attachment end of a hanging element of the present invention according to one embodiment of the invention.
Figure 31:
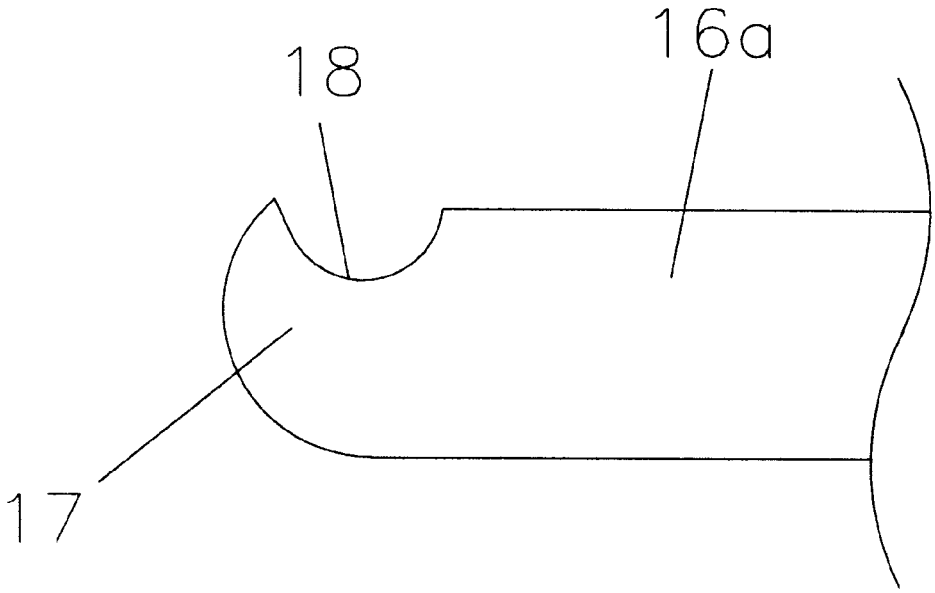
FIG. 31 is a sectional view of a radiused attachment end of a hanging element according to another embodiment of the invention.

An alternate embodiment is shown in FIGS. 27–31 in which base portion 17 is configured into the shape of a hook. Referring to FIGS. 27–31, the combination of neck portion 18 and bottom portion 17 conform to the shape of a hook. As shown in FIG. 30, the juncture of hanging member body 16*a* and bottom portion 17 can have a shoulder 33 or the juncture can be a smooth transition as shown in FIG. 31.

Figure 33:
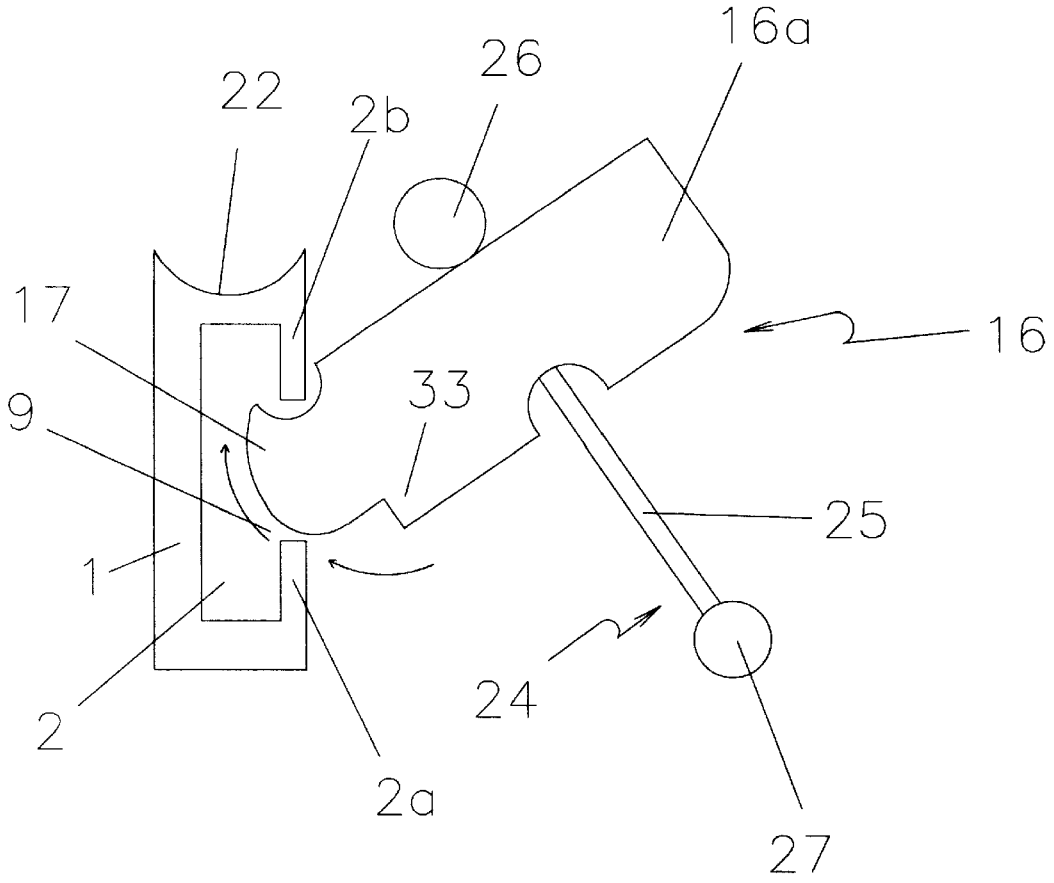
FIG. 33 is a side view of a multi-arm retractable hanging element being engaged with a base member according to one embodiment of the invention.
Figure 34:
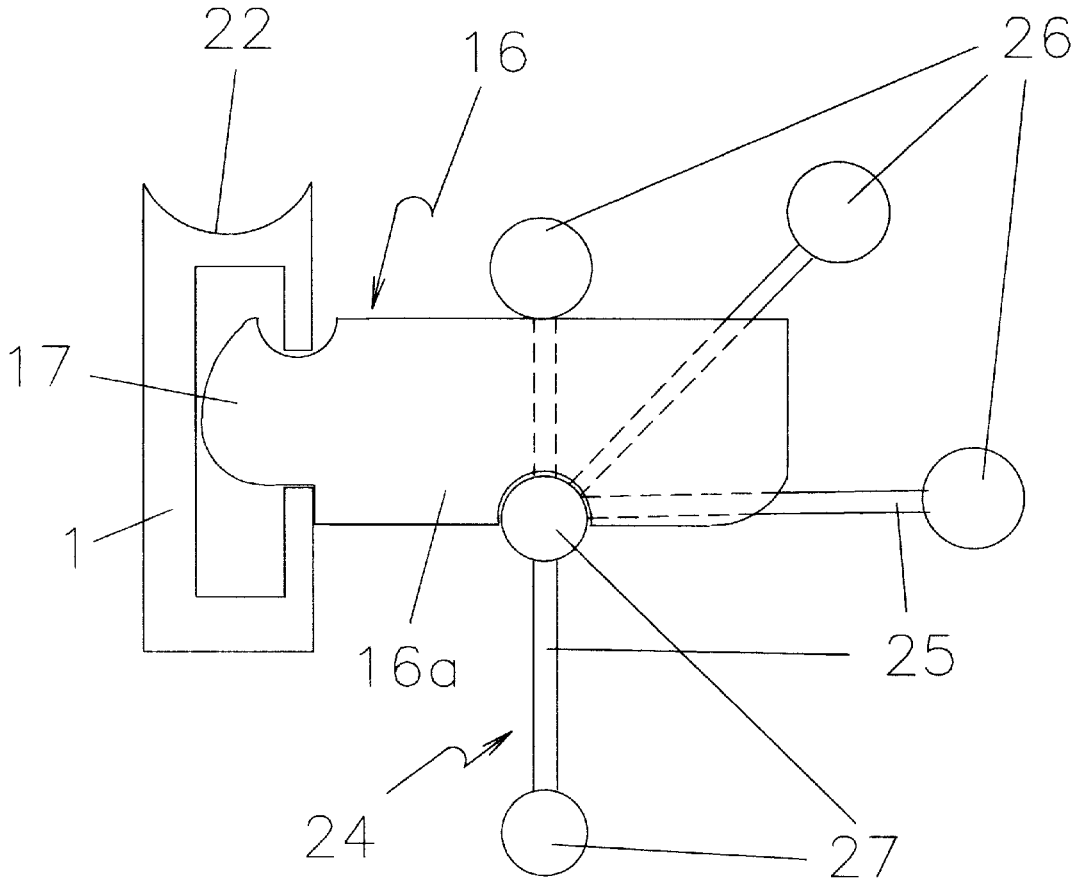
FIG. 34 is a side perspective view of a base member and multi-arm retractable hanging element according to one embodiment of the invention.

Referring now to FIG. 33, multi-arm retractable hanging element 16 is shown being engaged with base member 1. To properly engage multi-arm retractable hanging element 16 to base member 1 in accordance with the embodiment shown, bottom portion 17 is inserted into second section 9 and rotated up past upper flange 2*b* until shoulder 33 comes to rest against lower flange 2*a* as shown in FIG. 34. If there is no shoulder 33, rotation will be arrested when a back end of bottom portion 17 comes to rest against a back end of channel 2.

The hanging system employing the hooked bottom portion 17 allows for the front insertion of hanging elements that cannot be accommodated by a side insertion when both ends of channel 2 are blocked when, for example, the hanging system is mounted on a corner wall with the base member sandwiched between the corner and, for example, a cabinet. This problem is particularly extant when a large hanging element having a long base such as the multi-arm retractable hanging element is utilized. By employing the combination of base member 1 with a hanging element having the hooked bottom portion shown in either FIG. 30 or 31, any problems associated with side mounting of hanging elements is effectively eliminated.

With respect to the hanging elements that can be used with the front-mount system, any of the hanging elements depicted in the drawings, e.g., FIGS. 8–11, can be designed with the hooked bottom portion to allow for front-end mounting.

Figure 12:
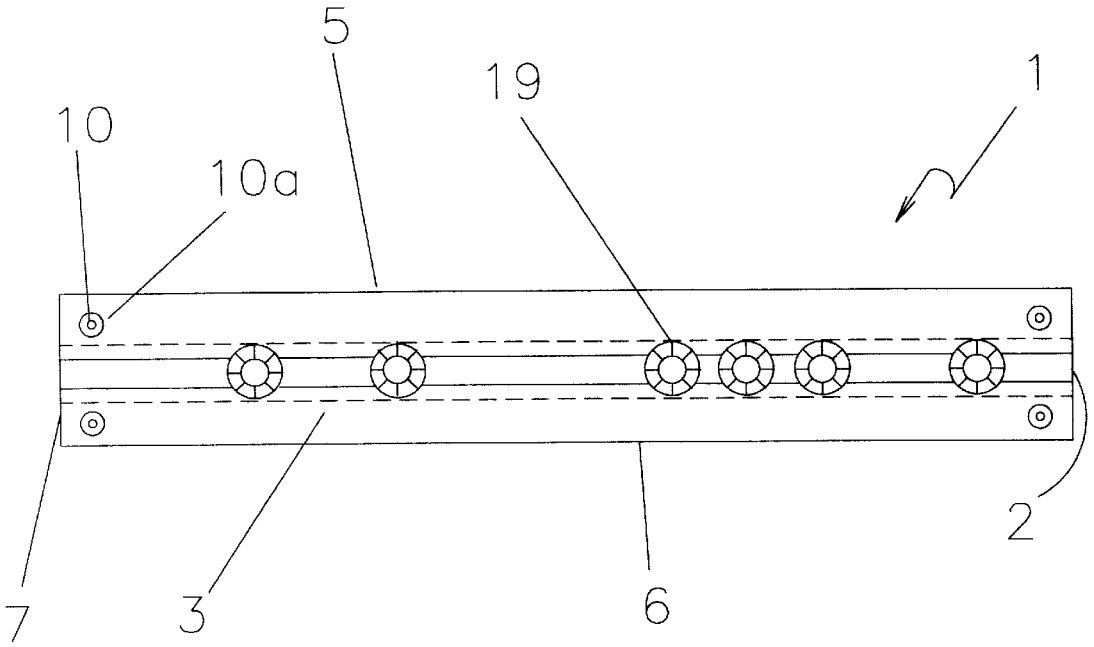
FIG. 12 is a front elevational view of one embodiment of the invention.
Figure 13:
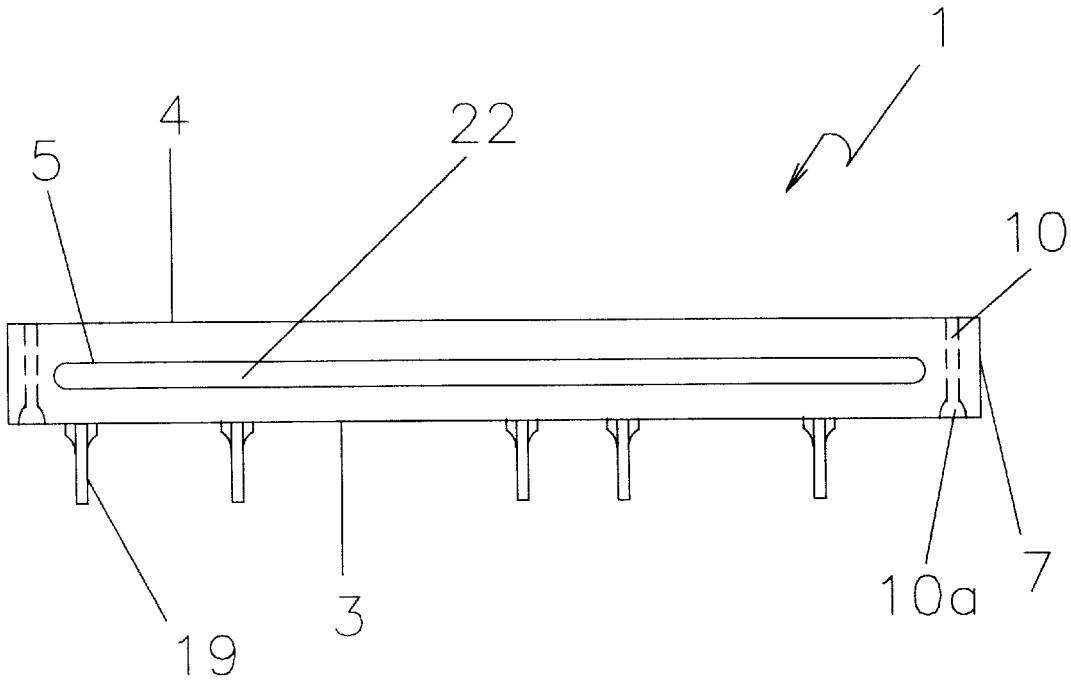
FIG. 13 is a top view of one embodiment of the invention.
Figure 14:
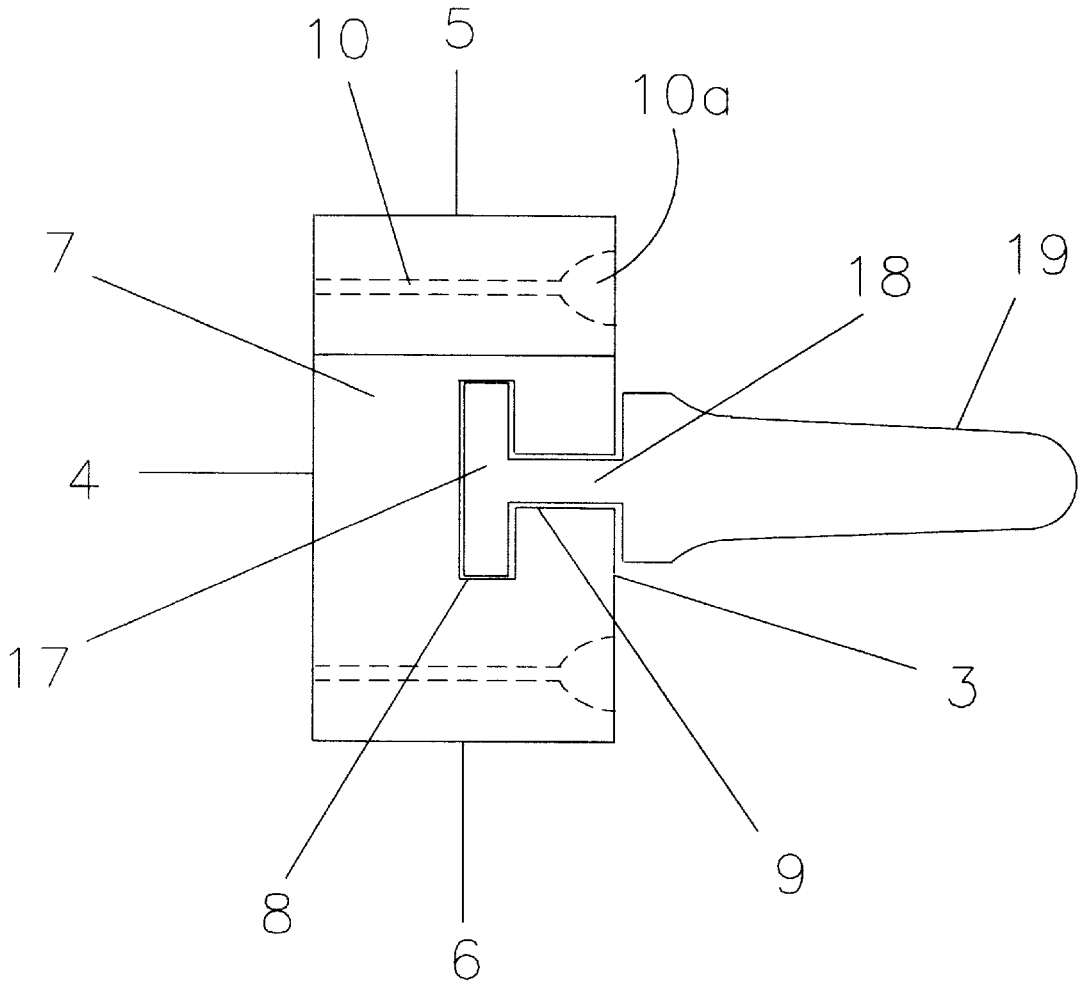
FIG. 14 is a side view of one embodiment of the invention.

Referring to FIGS. 12, 13 and 14, to assemble the present invention, hanging element 16 (with or without a radiused bottom portion) is positioned for insertion into channel 2 from one of the sides 7. Hanging elements 16 are slid into channel 2 until located at the desired position. The same procedure is used to place additional hanging elements 16 along channel 2. The same procedure is used when assembling hanging elements 16 with channel 13.

Figure 14A:
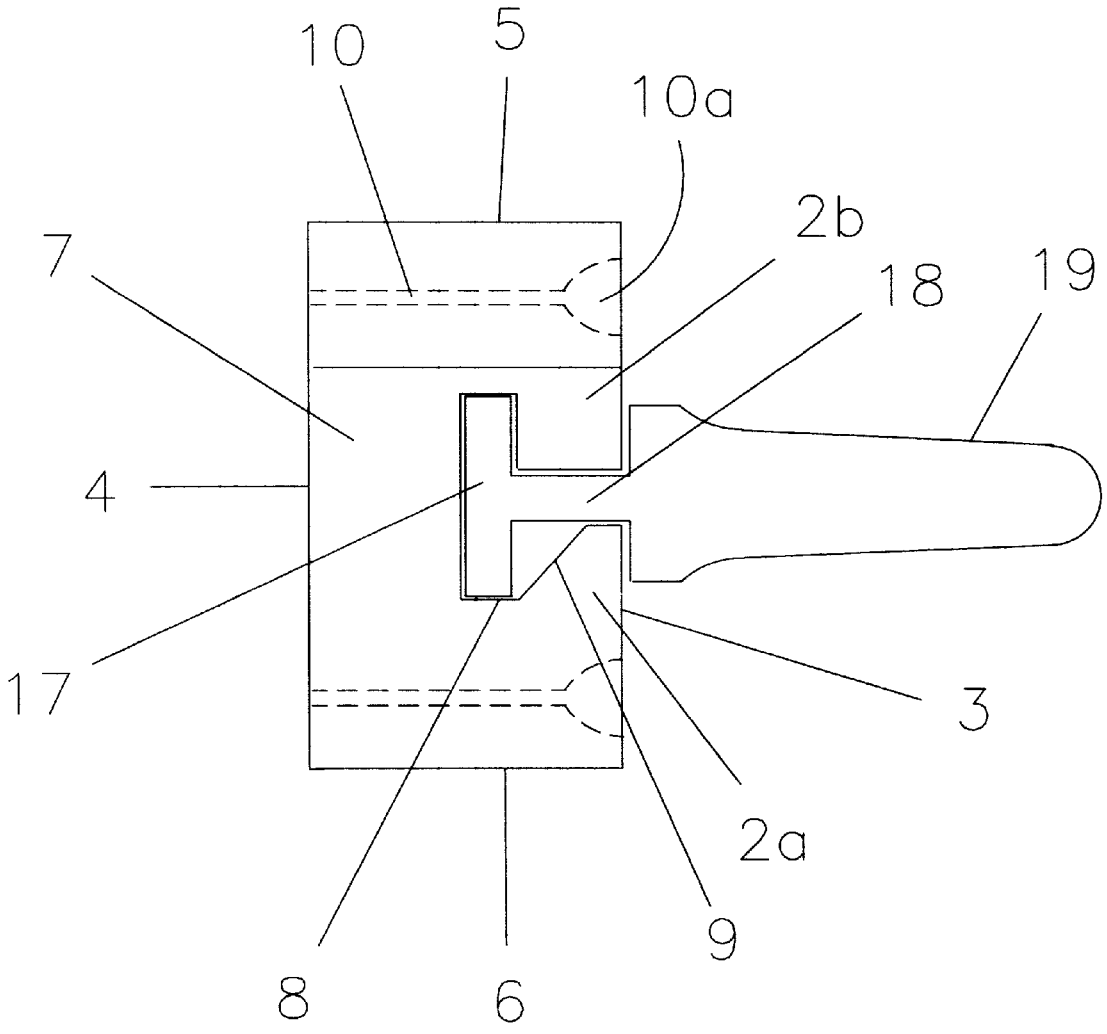
FIG. 14*a* is a side view according to one embodiment of the invention.
Figure 19:
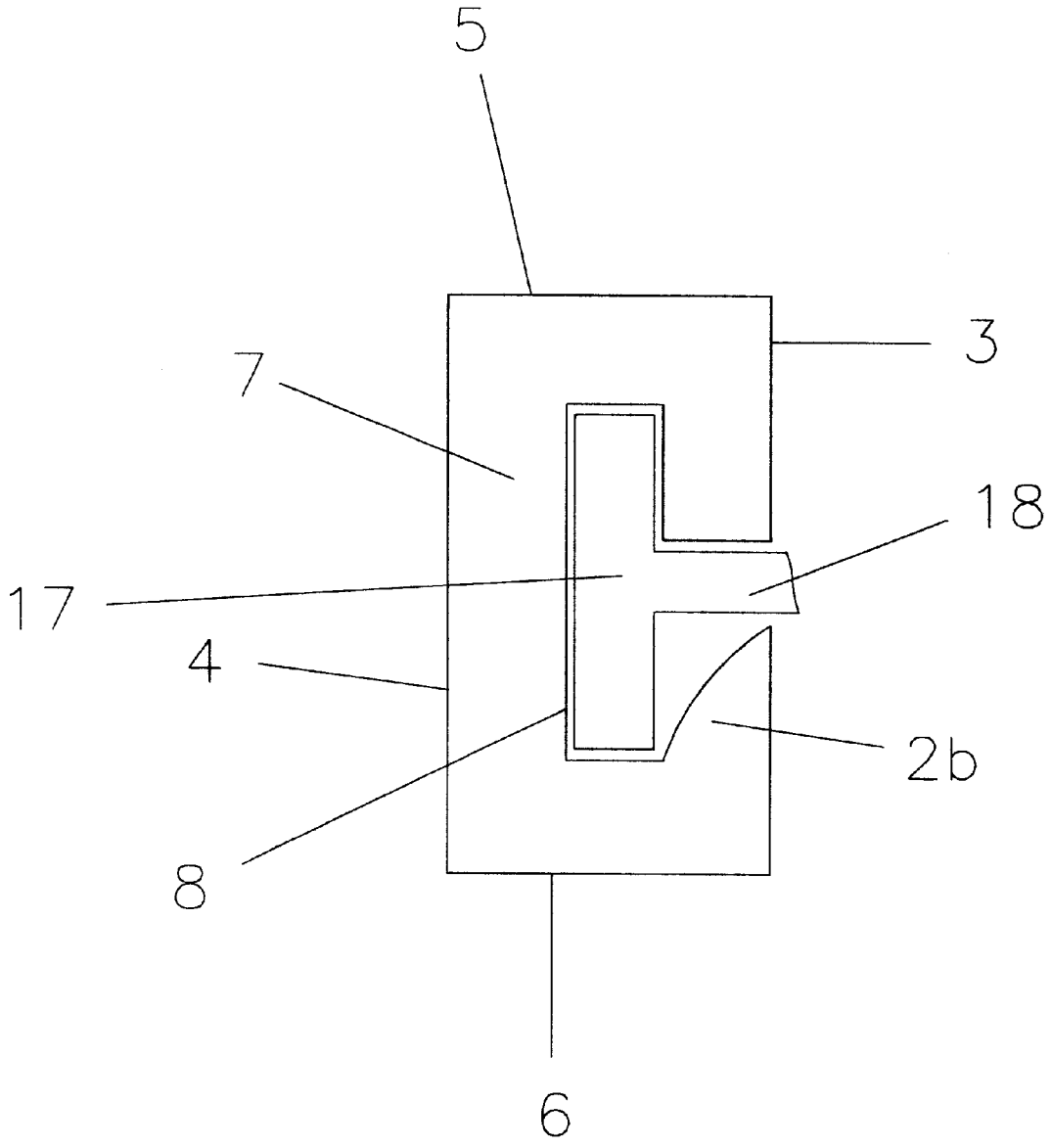
FIG. 19 is a side view of the base member and first channel according to one embodiment of the invention.

In an alternate embodiment as shown in FIG. 14*a*, the present invention can be assembled by positioning and inserting hanging element 16 into second section 9 by angling hanging element bottom portion 17 into second section 9 and pivoting hanging element 16 into channel 2. The relatively loose fitting bottom portion 17 due to the chamfer of lower flange 2*a* (or upper flange 2*b* as shown in FIG. 15*a*) will not affect the function of the hanging system. The same is true if one of the two flanges is radiused instead of chamferred as shown in FIG. 19. Placement of an article on top portion 19 will torque the hanging element 16 into locking engagement with channel 2.

Figure 15:
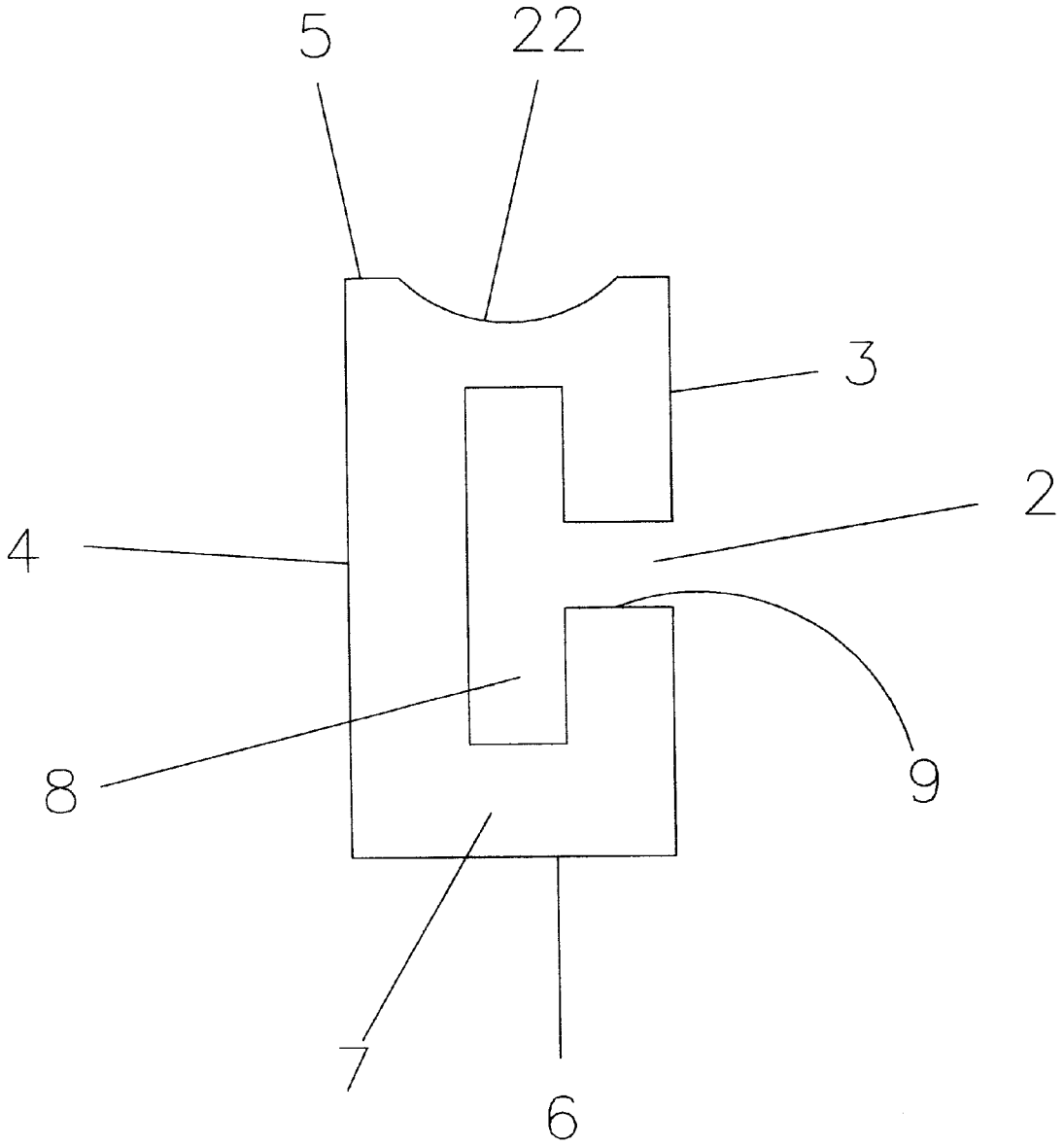
FIG. 15 is a side view of the base member and first and second channels of an embodiment of the invention.
Figure 15A:
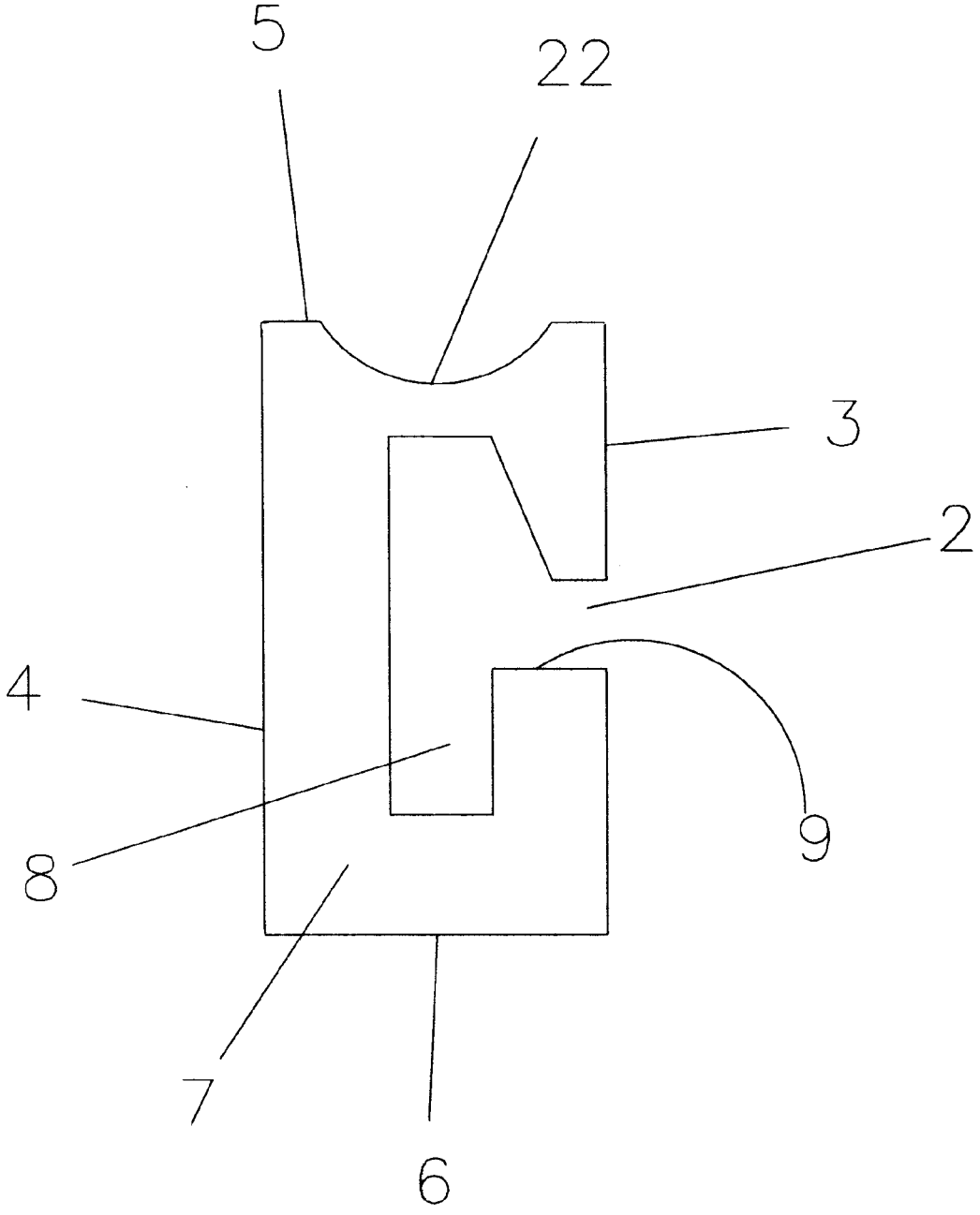
FIG. 15*a* is a side view of the base member and first and second channels according to one embodiment of the invention.

Turning to FIG. 15, a second channel 22, in top surface 5, is adapted to conform to the shape of bottom portion 17 of hanging elements 16. Any hanging elements 16 that are not being used in channel 2 (hanging elements 16 not being used in channel 2 are defined as being in an inactive state and hanging elements in channel 2 are defined as being in an active state), can be stored by placing inactive state hanging elements 16 in second channel 22. By being in mating engagement with bottom portion 17, second channel 22 prevents hanging element 16 from falling off of top surface 5 when the present invention is mounted onto a vertical support surface. However, regardless of the shape of bottom portion 17, second channel 22 can also have a simple cove shape with sufficient depth, to prevent inactive state hanging elements 16 from falling off of top surface 5 when placed in second channel 22. When the present invention is mounted on a horizontal support surface like a ceiling, unused hanging elements 16 can be stored by grouping them together at one end of channel 2.

Figure 16:
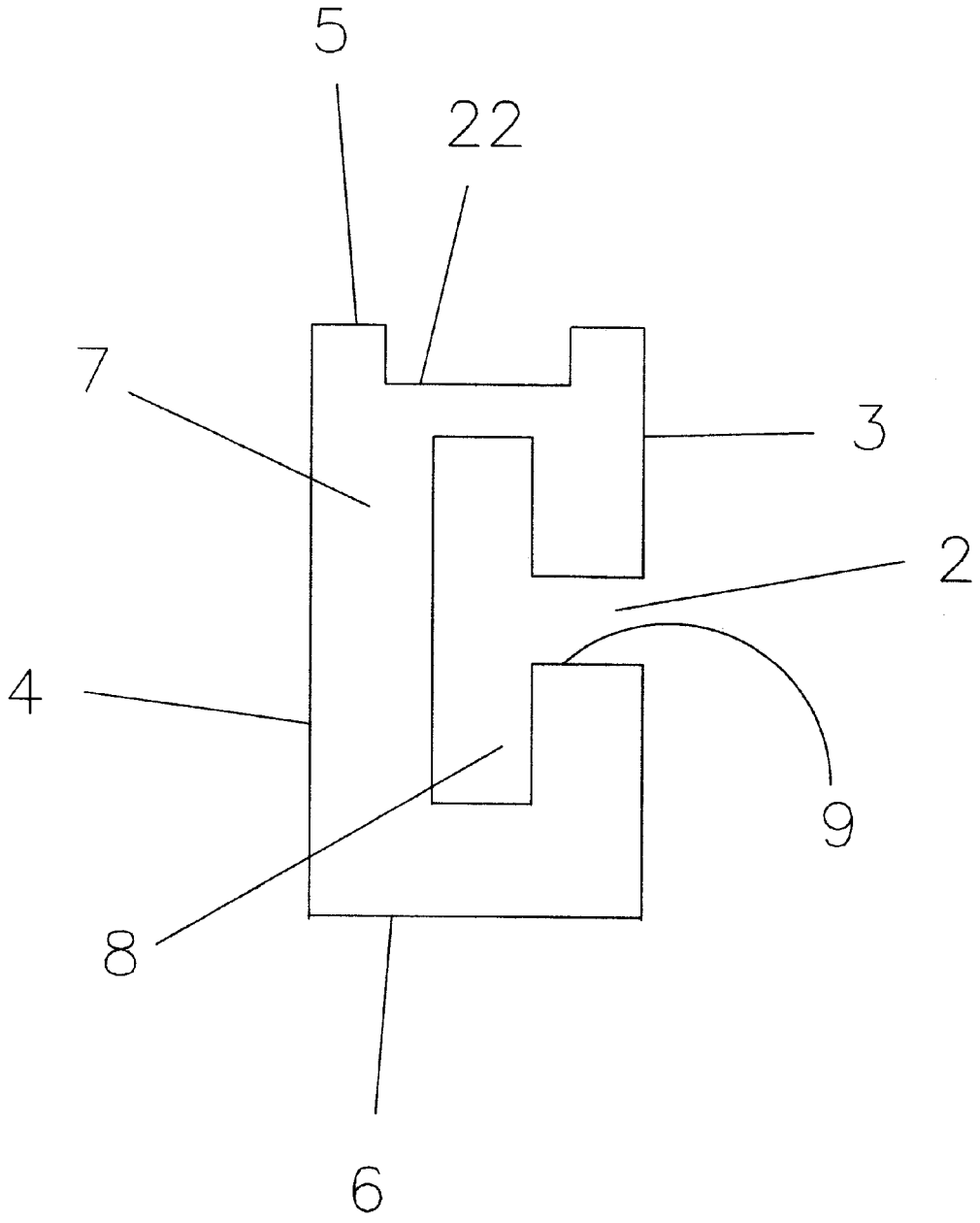
FIG. 16 is a side view of the base member and first and second channels of a another embodiment of the invention.

In another embodiment, as shown in FIG. 16, second channel 22 can be shaped as a square or rectangular groove. This shape is used if bottom portion 17 of hanging element 16 is shaped in the form of a square or rectangle.

Figure 17:
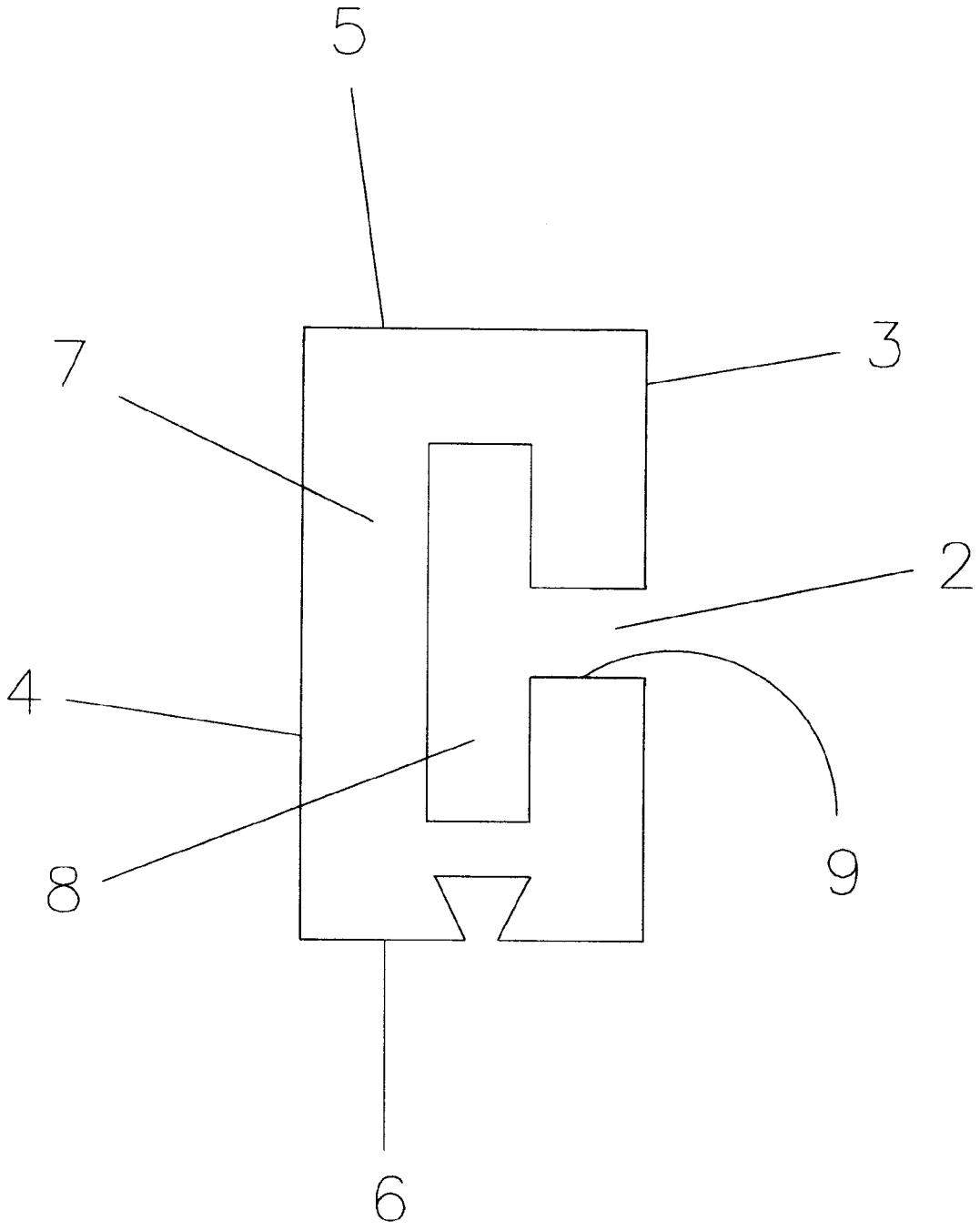
FIG. 17 is a side view of the base member and first and second channels of a further embodiment of the invention.

In a still further embodiment, as shown in FIG. 17, second channel 22 can be formed on bottom surface 6 with a frusto-conical shape. This is an alternative effective structure for storing hanging elements 16 that are not in use if bottom portion 17 has a frusto-conical cross-sectional shape that conforms to the shape of second channel 22. Second channel 22 can also be shaped identical to channel 2 as shown in FIG. 1.

Figure 18:
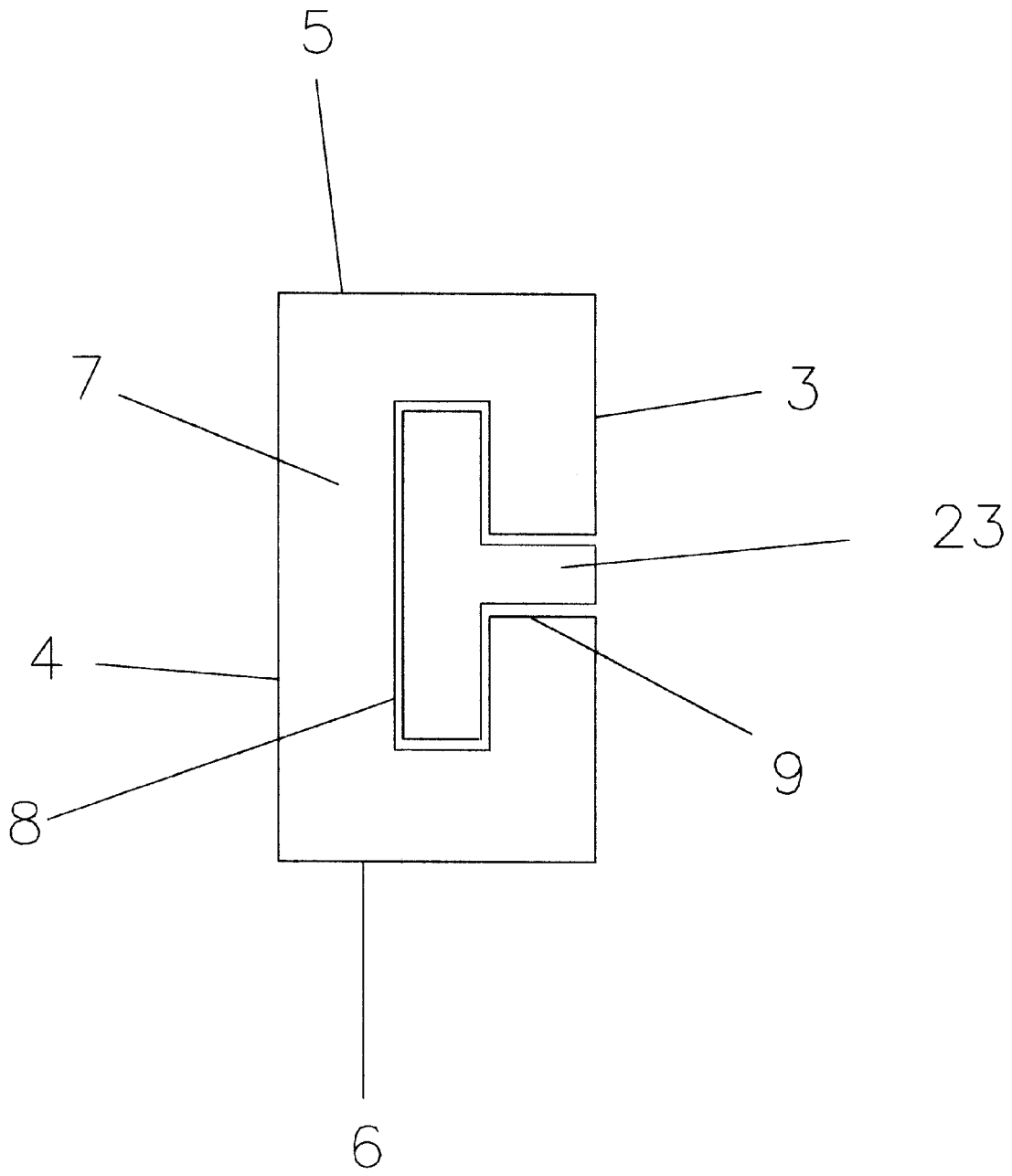
FIG. 18 is a side view of the base member, first channel and end-stop of one embodiment of the present invention.

Referring to FIG. 18, to prevent hanging elements 16 from sliding out of channel 2 by way of sides 7, end-stop 23 can be placed in either or both sides 7. End-stop 23 is shaped to conform to the shape of channel 2 and designed to be releasably locked into channel 2. If preferred, end-stop 23 can be permanently secured to channel 2. To ensure that end-stop 23 is securely in place, end-stop 23 can be secured to channel 2 by means of an adhesive or an appropriate mechanical fastener such as a screw or nail. End-stop 23 can be made of any suitable material such as wood, metal, plastic, rubber, or synthetic rubber.

It is to be understood that the present invention is by no means limited to the particular constructions herein disclosed and/or shown in the drawings, but also comprises any modifications or equivalents within the scope of the claims.

Having thus described our invention, what we claim as new and desire to secure by United States Letters Patent is:

1. An adjustable hanger system comprising:

a base member having a front surface, back surface, top surface, bottom surface and two sides, said base member having portions defining at least one channel, the at least one channel opening to the front surface; and, at least one hanging element adapted to slideably and matingly engage the at least one channel of the base member wherein the at least one hanging element comprises a hanging element body having at least one radially extended channel situated on a top surface of the hanging element body wherein the at least one radially extended channel opens on a front surface of the hanging element body opposite a portion of the hanging element body that engages the at least one channel of the base member, a substantially horizontal linear channel situated on a bottom surface of an hanging element body and at least one aperture formed from an intersection of the at least one radially extended channel and the linear channel.

2. The hanger system of claim 1 wherein the at least one hanging element further comprises at least one retractable arm comprising a retractable arm shaft, an internal end ball and an external end ball wherein the shaft is sized to freely slide within the at least one aperture.

3. The adjustable hanger system of claim 2 wherein the linear channel runs at least partially across a length of the hanging element body and is releasably and matingly engageable with the internal end ball.

4. The adjustable hanger system of claim 2 wherein the internal end ball is sized sufficiently large enough to arrest movement of the retractable arm shaft through the at least one aperture.

5. The adjustable hanger system of claim 2 wherein the at least one radially extended channel is sized to releasably and matingly engage the at least one retractable arm.

6. The adjustable hanger system of claim 2 wherein the external end ball is sized so the at least one retractable arm cannot pass through the at least one aperture.

7. The adjustable hanger system of claim 2 wherein the internal end ball is sized to matingly engage the linear channel.

8. The hanger system of claim 1 wherein the hanging element has a neck portion that has a radius profile.

9. The hanger system of claim 1 wherein the at least one hanging element has a radiused bottom portion whereby said at least one hanging element can be inserted into the at least one channel from the front surface of the base member.

10. The hanger system of claim 9 wherein the base member further comprises at least one bore hole for mounting the base member to a support surface.

11. The hanger system of claim 10 further comprising a mechanical fastener for fastening the base member to a support surface, wherein the mechanical fastener is sized and adapted to be received in the at least one bore hole.

12. The hanger system of claim 9 wherein the base member further comprises an adhesive on the back surface of the base member for mounting the base member on a support surface.

13. The hanger system of claim 1 wherein the at least one channel has a first section and a second section;

the first section has a first length dimension, taken along a plane between the top surface and the bottom surface of the base member which is greater than a second length dimension of the second section wherein the second section is proximal to the front surface of the base member relative to the first section which is distal to the front surface of the base member.

14. The hanger system of claim 13 wherein the first section has a rectangular cross-sectional shape.

15. The hanger system of claim 13 wherein the at least one hanging element has a radiused bottom portion whereby said at least one hanging element can be inserted into the second section from the front surface of the base member.

16. A method for hanging an object in a selected position comprising:

providing a base member having portions defining at least one channel of the base member;

providing at least one hanging element adapted to slideably and matingly engage the at least one channel of the base member wherein the at least one hanging element comprises a hanging element body having at least one radially extended channel situated on a top surface of the hanging element body wherein the at least one radially extended channel opens on a front surface of the hanging element body opposite the portion of the hanging element body that engages the at least one channel of the base member, a substantially horizontal linear channel situated on a bottom surface of the hanging element body and at least one aperture formed from an intersection of the at least one radially extended channel and the linear channel;

inserting the at least one hanging element into the at least one channel of the base member and, hanging an object from the hanging element.

17. The method of claim 16 comprising the further steps of providing the at least one hanging element with a radiused bottom portion whereby the at least one hanging element can be inserted into the at least one channel from the front surface of the base member.

18. The adjustable hanger system of claim 2 wherein the linear channel has a cross-sectional shape that substantially conforms to the shape of the internal end ball so that the end ball reversibly mates with the linear channel when in contact with the linear channel.

* * * * *